US005403704A

United States Patent [19]

Yoshioka et al.

[11] Patent Number: 5,403,704

[45] Date of Patent: Apr. 4, 1995

[54] SILVER HALIDE COLOR PHOTOGRAPHIC MATERIAL

[75] Inventors: Yasuhiro Yoshioka; Shigeo Hirano; Makoto Suzuki, all of Kanagawa, Japan

[73] Assignee: Fuji Photo Film Co., Ltd., Kanagawa, Japan

[21] Appl. No.: 20,994

[22] Filed: Feb. 22, 1993

[30] Foreign Application Priority Data

Feb. 21, 1992 [JP] Japan ..... 4-070027

[51] Int. Cl.[6] ..... G03C 1/46

[52] U.S. Cl. ..... 430/505; 430/384; 430/385; 430/558; 430/598; 430/264

[58] Field of Search ..... 430/558, 384, 385, 505, 430/264, 598

[56] References Cited

U.S. PATENT DOCUMENTS 4,923,787 5/1990 Harder ..... 430/264
5,028,510 7/1991 Okamura et al. ..... 430/264
5,061,594 10/1991 Okamura et al. ..... 430/264
5,164,289 11/1992 Shimada et al. ..... 430/558
5,215,871 6/1993 Sato et al. ..... 430/385
5,230,992 7/1993 Miyahashi et al. ..... 430/551
5,256,526 10/1993 Suzuki et al. ..... 430/385
5,270,153 12/1993 Suzuki et al. ..... 430/385

FOREIGN PATENT DOCUMENTS 0488248 6/1992 European Pat. Off. .
0491197 6/1992 European Pat. Off. .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic material which contains at least one pyrrolotriazole cyan coupler having two electron attracting groups and at least one non-color forming, nondiffusing compound.

15 Claims, No Drawings

SILVER HALIDE COLOR PHOTOGRAPHIC MATERIAL

FIELD OF THE INVENTION

This invention relates to a silver halide color photographic material containing a novel cyan dye forming coupler and more particularly to a silver halide color photographic material which has improved properties with regard to the absorption characteristics of dyes and color mixing during processing and moreover which has improved preservability of dye images against light and heat.

BACKGROUND OF THE INVENTION

Dye images can be formed by the reaction of dye forming couplers (hereinafter referred to simply as couplers) with the oxidation product of aromatic primary amine developing agents when silver halide color photographic materials are exposed to light and then subjected to color development.

In such a system as described above, color reproduction is generally achieved by subtractive color photography. Yellow, magenta and cyan dye images having the relationship of complementary colors to light are formed to reproduce blue, green and red colors. Generally, acylacetamide couplers and malondianilide couplers are used as yellow dye forming couplers (hereinafter referred to as yellow couplers) to form a yellow dye image; 5-pyrazolone couplers and pyrazolotriazole couplers are used as magenta couplers to form a magenta dye image; and phenol couplers and naphthol couplers are used as cyan couplers to form a cyan dye image.

The yellow dye, magenta dye and cyan dye obtained from these couplers are generally formed in silver halide emulsion layers sensitive to radiation having a relationship of complementary colors to the radiation absorbed by the dyes or in layers adjacent thereto. The application of color couplers to sensitive layers is not limited to the above-described layers, and color couplers can be employed in light-sensitive layers which do not have such a relationship of complementary colors to light as described above. For example, color couplers can be used in silver halide emulsions sensitive to the infrared ray region.

Of the above-described couplers, phenol couplers and naphthol couplers are conventionally used as cyan dye forming couplers. This is because these couplers have fully satisfactory performance with regard to the reactivity thereof with the oxidation product of developing agents. However, the absorption of dyes obtained from these couplers are broad and extend into the green light region. In addition, the dyes have secondary absorption in the blue light region. The above-described absorption characteristics are disadvantageous properties in color reproduction and have a serious effect on the reproduction of blue color and green color.

Various attempts have been made to improve the absorption characteristics as described above. For example, European Patent Application 0 249 453 A discloses diphenylimidazole type cyan couplers wherein absorption in the short wavelength side is sharp. U.S. Pat. Nos. 4,873,183 and 4,916,051 disclose cyan couplers having a pyrazoloazole skeleton. JP-A-63-281161 (the term "JP-A" as used herein means an "unexamined published Japanese patent application") and JP-A-63-280247 disclose cyan couplers having a pyrazolobenzimidazole skeleton. However, all of these couplers have poor developability, that is, they have poor reactivity with the oxidation product of p-phenylenediamine developing agents, and dyes formed have low fastness. Accordingly, a further improvement is required.

European Patent Application 0 456 226 A1 discloses pyrrolopyrazole cyan couplers which have relatively high developability and have excellent developed dye hue. Further, the fastness of the dyes formed therefrom to heat is greatly improved in comparison with the above described couplers.

However, it was found that the fastness of dye images formed from these couplers is poor under high temperature and humidity conditions particularly in the low density region. Further, it was found that when these couplers are present in light-sensitive materials and developed, color mixing is increased, even though absorption spectra have excellent characteristics.

As described above, phenol couplers and naphthol couplers conventionally used have a disadvantage in their spectral absorption characteristics. A problem to be solved from the standpoint of improving the spectral absorption characteristics is the color mixing caused by the movement of the oxidation product of the developing agents during processing, and another problem to be solved is poor fastness of dye images during storage under high temperature and humidity conditions. The former problem can be reduced by increasing the coating weights of color mixing inhibitors. However, when the coating weights of the color mixing inhibitors are increased, the thicknesses of layers are increased, and problems occur in that sharpness is lowered, and the load in conducting rapid processing is increased.

The present inventors have conducted research to solve the problems associated with prior art, and the present invention has been accomplished as a result of this research.

SUMMARY OF THE INVENTION

Accordingly, an object of the present invention is to provide a color photographic material which has excellent color reproducibility.

Another object of the present invention is to provide a color photographic material where color mixing by processing scarcely occurs.

Still another object of the present invention is to provide a color photographic material which provides a dye image having excellent fastness.

The above-described objects of the present invention are achieved by a silver halide color photographic material comprising a support having thereon at least one layer containing at least one pyrroloazole cyan coupler represented by the following general formula (I), (II) or (III)

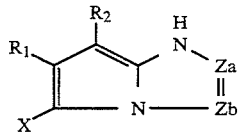

(I)

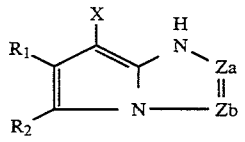

(II)

-continued

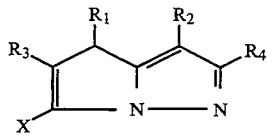

(III)

wherein Za and Zb each represents —C($R_4$)= or —N= provided that one of Za and Zb is —N= and the other is —C($R_4$)=; $R_1$ and $R_2$ each represents an electron attracting group having a Hammett's substituent constant $\sigma_p$ value of at least 0.20, and the sum of the $\sigma_p$ values of $R_1$ and $R_2$ in the general formula (I) or (II) is at least 0.65; $R_3$ and $R_4$ each represents a hydrogen atom or a substituent; X represents a hydrogen atom or a group which is eliminated on coupling reaction with the oxidation product of an aromatic primary amine color developing agent; or $R_1$, $R_2$, $R_3$, $R_4$ or X may be a divalent group and the compound may exist in the form of a dimer or a higher polymer through the divalent group or the compound may form a homopolymer or a copolymer of a monomer or monomers wherein the residue of the compound is bonded to a high-molecular weight chain; and at least one member of non-color forming, nondiffusing compounds represented by the following general formula (H)

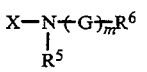

(H)

wherein X represents —N($R^7$)$R^8$ or —O$R^9$; $R^7$ represents a hydrogen atom, an aliphatic group, an aromatic group or a heterocyclic group; $R^8$ and $R^9$ each represents a hydrogen atom or a group which can be eliminated under alkaline conditions; $R^6$ represents a hydrogen atom, an aliphatic group, an aromatic group, a heterocyclic group, a cyano group, a nitro group or a hydrazino group; or $R^7$ and $R^6$ may be combined together to form a ring; $R^5$ represents a hydrogen atom, an alkyl group or a group which is eliminated under alkaline conditions; two or more members of the compounds of general formula (H) may be bonded to each other at the position of $R^7$, $R^6$ or $R^5$ to form an oligomer or a polymer; G represents —CO—, —$SO_2$—, —SO—, —CON($R^{10}$)—, —COO—, —$SO_2$N($R^{11}$)—, —PO($R^{12}$)—, —C(=S)— or an iminomethylene group; $R^{10}$ and $R^{11}$ each represents a hydrogen atom, an alkyl group or an aryl group; $R^{12}$ represents an alkyl group or an aryl group; m represents 0, 1 or 2 and when m is 2, two G groups may be the same or different.

DETAILED DESCRIPTION OF THE INVENTION

Now, the present invention is illustrated in greater detail below.

First, the cyan couplers of the present invention will be illustrated below.

Za and Zb each represents —C($R_4$)= or —N= provided that one of Za and Zb is —N= and the other is —C($R_4$)=.

More specifically, the cyan couplers of general formulas (I) and (II) can be specifically represented by the following general formulas (I-a), (I-b), (II-a) and (II-b).

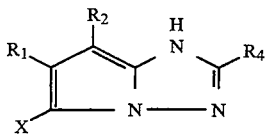

(I-a)

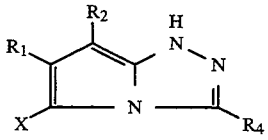

(I-b)

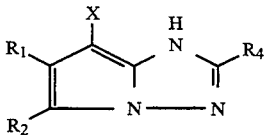

(II-a)

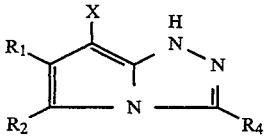

(II-b)

wherein $R_1$, $R_2$, $R_4$ and X are as defined above in general formula (I) or (II).

In the present invention, the cyan couplers of general formula (I), namely, (I-a) or (I-b) are preferred. The cyan couplers of general formula (I-a) are more preferred.

$R_3$ and $R_4$ each represents a hydrogen atom or a substituent. Examples of substituents include a halogen atom, an alkyl group, an aryl group, a heterocyclic group, a cyano group, a hydroxy group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group and an azolyl group. These groups may be further substituted. Examples of suitable substituents include those already described above in the definition of the substituents for $R_3$.

More specially, $R_3$ and $R_4$ are each a hydrogen atom, a halogen atom (e.g., a chlorine atom, a bromine atom), an alkyl group (e.g., a straight-chain or branched alkyl group having 1 to 32 carbon atoms, an aralkyl group, an alkenyl group, an alkynyl group, a cycloalkyl group or a cycloalkenyl group such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzthiazolyl), a cyano group, a hydroxy group, a nitro group, a carboxyl group, a sulfo group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylpheoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido, an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{2-(3-t-butyl-4-hydroxyphenoxy)dodecaneamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl), a sulfamoyl group (e.g., N-ethylsulfamoyl, N,N-dirpropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzthiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazolyl).

Preferably, $R_3$ and $R_4$ are each an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group or an azolyl group.

More preferably, $R_3$ and $R_4$ are each an alkyl group or an aryl group. Still more preferably, $R_3$ and $R_4$ are each an alkyl group having at least one substituent or an aryl group having at least one substituent. An aryl group having at least one substituent selected from the group consisting of an alkoxy group, a sulfonyl group, a sulfamoyl group, a carbamoyl group, an acylamido group and a sulfonamido group is further preferable. An aryl group having at least one acylamido or sulfonamido group as a substituent is particularly preferred.

In the cyan couplers of the present invention, $R_1$ and $R_2$ are each an electron attractive group having $\sigma_p$ value of at least 0.20. In the cyan couplers of general formulas (I) and (II), cyan dye images can be formed when the sum of $\sigma_p$ values of $R_1$ and $R_2$ is at least 0.65. In the cyan couplers of general formula (III), the sum of $\sigma_p$ values of $R_1$ and $R_2$ is preferably at least 0.65. Preferably, the sum of $\sigma_p$ values of $R_1$ and $R_2$ is at least 0.70. The upper limit thereof is about 1.8.

$R_1$ and $R_2$ are each an electron attractive group having a Hammett's substituent constant $\sigma$ value of at least 0.20, preferably at least 0.30. The upper limit thereof is not more than 1.0. Hammett's rule is an empirical rule proposed by L. P. Hammett in 1935 to discuss quantitatively the effect of substituent groups on the reaction of benzene derivatives or the equilibrium thereof. The propriety thereof is widely recognized at present.

Substituent constants determined by Hammett's rule are a $\sigma_p$ value and a $\sigma_m$ value. These values are described in the literature. For example, these values are described in J. A. Dean, *Lange's Handbook of Chemistry,* 12th Edition (McGraw-Hill 1979), and *Region of Chemistry,* Extra Issue, No. 122, pp. 96–103 (published by Nankodo 1979). In the present invention, Hammett's substituent constant of $R_1$ and $R_2$ is limited to $\sigma_p$ value. However, this does not means that $R_1$ and $R_2$ are limited to substituents whose values are known in the literature. It is to be understood that substituent whose values are not known from the literature are also included with the scope of the present invention, so long as the values are in the range of known values when measured by Hammett's rule.

Examples of the electron attracting group having a $\sigma_p$ value of at least 0.20 represented by $R_1$ and $R_2$ include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted with another electron attracting group having a $\sigma_p$ value of at least 0.20, a heterocyclic group, a halogen atom, an azo group and a selenocyanato group. These may be further substituted when they can be substituted. Examples of substituents include those already described above in the definition of the substituents for $R_3$.

More specifically, examples of electron attracting groups having $\sigma_p$ value of at least 0.20 represented by $R_1$ and $R_2$ include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N(4-n-pentadecaneamido)phenylcarbamoyl, N-methyl-N-dodecylcarbamoyl, N-{3-(2,4-di-t-amylphenoxy)-propyl}carbamoyl), an alkoxycarbonyl group (e.g., methoxycarbonyl, ethoxycarbonyl, isopropyloxycarbonyl, tertbutyloxycarbonyl, isobutyloxycarbonyl, butyloxycarbonyl, dodecyloxycarbonyl, octadecyloxycarbonyl), an aryloxycarbonyl group (e.g., phenoxycarbonyl), a cyano group, a nitro group, a dialkylphosphono group (e.g., dimethyl phosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanato group, a thiocarbonyl group (e.g., methylthiocarbonyl, phenylthiocarbonyl), a halogenated alkyl group (e.g., trifluoromethane, heptafluoropropane), a halogenated alkoxy group (e.g., trifluoromethyloxy), a halogenated aryloxy group (e.g., pentafluorophenyloxy), a halogenated alkylamino group (e.g., N,N-di(trifluoromethyl)amino), a halogenated alkylthio group (e.g., difluoromethylthio, 1,1,2,2-tetrafluoroethylthio), an aryl group substituted by another electron attractive group having a $\sigma_p$ value of at least 0.20 (e.g., 2,4-dinitrophenyl, 2,4,6-trichlorophenyl, pentachlorophenyl), a heterocyclic group (e.g., 2-benzoxazolyl, 2-benzthiazolyl, 1-phenyl-2-benzimidazolyl, 5-chloro-1-tetrazolyl, 1-pyrrolyl), a halogen atom (e.g., chlorine, bromine), an azo group (e.g., phenylazo) and a selenocyanato group. These may be further substituted when they can be substituted. Examples of substituents include those already described above in the definition of the substituents for $R_3$.

Preferably, $R_1$ and $R_2$ are each an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted by at least two other electron attracting groups having a $\sigma_p$ value of at least 0.20 or a heterocyclic group. More preferably, $R_1$ and $R_2$ are each an alkoxycarbonyl group, a nitro group, a cyano group, an arylsulfonyl group, a carbamoyl group or a halogenated alkyl group.

Most preferably, $R_1$ is a cyano group. Particularly preferably, $R_2$ is a cyano group or an alkoxycarbonyl group.

X represents a hydrogen atom or an atom or group which is eliminated by coupling with the oxidation product of an aromatic primary amine color developing agent. Examples of the eliminable atoms or groups represented by X include a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a five-membered or six-membered nitrogen-containing heterocyclic group, an imido group and an arylazo group. These groups may be further substituted. Examples of substituents include those already described above in the definition of the substituents for $R_3$.

More specifically, examples of eliminable atoms or groups represented by X include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a five-membered or six-membered nitrogen containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an arylazo group (e.g., phenylazo, 4-methoxyphenylazo). In addition, X may be optionally in the form of a his type coupler formed by condensing a four equivalent type coupler with an aldehyde or a ketone as an eliminable group bonded thereto through carbon atoms. Further, X may contain a photographically useful group such as a restrainer or a development accelerator.

Preferably, X is a halogen atom, an alkoxy group, an aryloxy group, an alkyl- or arylthio group or a five-membered or six-membered nitrogen-containing heterocyclic group bonded to the coupling site through a nitrogen atom. More preferably, X is a halogen atom or an alkyl- or arylthio group. Particularly preferred is an arylthio group.

In the cyan couplers of general formula (I), (II) or (III) according to the present invention, $R_1$, $R_2$, $R_3$, $R_4$ or X may be a bivalent group, and the couplers may be in the form of a dimer or a higher polymer through the bivalent group, or the couplers may be in the form of a homopolymer or a copolymer of compounds wherein the coupler is bonded to a high-molecular weight chain. Typical examples of homopolymers or copolymers of compounds wherein the coupler is bonded to a high-molecular weight chain are homopolymers or copolymers of addition polymer type ethylenically unsaturated compounds having at least one residue of a cyan coupler of the general formula (I), (II) or (III). In this case, the polymers may comprises one or more members of cyan color forming repeating units having a residue of the cyan couplers of general formula (I), (II) or (III), or the copolymers may comprise, in addition thereto, one or more units derived from one more non-color forming monomers as copolymer components. Preferred cyan color forming repeating units having a residue of the cyan couplers of general formula (I), (II) or (III) are those represented by the following general formula (P).

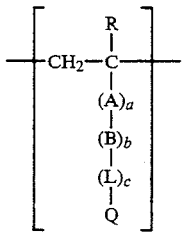

(P)

wherein R represents a hydrogen atom, an alkyl group having 1 to 4 carbon atoms or chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b and c each represents 0 or 1; and Q represents a cyan coupler residue formed by removing a hydrogen atom from $R_1$, $R_2$, $R_3$, $R_4$ or X of a compound of general formula (I), (II) or (III). The phenylene, alkylene, and aralkylene groups may be further substituted. Examples of suitable substituents include those already described above in the definition of the substituents for $R_3$ of general formula (III).

As polymers, preferred are copolymers of cyan color forming monomers represented by coupler units of general formula (I), (II) or (III) with non-color forming ethylenic monomers which do not couple with the oxidation product of aromatic primary amine developing agents.

Examples of non-color forming ethylenic monomers which do not couple with the oxidation product of aromatic primary amine developing agents include acrylic acid, α-chloroacrylic acid, α-alkylacrylic acids (e.g., methacrylic acid) and amides and esters derived from these acrylic acids (e.g., acrylamide, methacrylamide, n-butyl acrylamide, t-butyl acrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate), vinyl esters (e.g., vinyl acetate, vinyl propionate, vinyl laurate), acrylonitrile, methacrylonitrile, aromatic vinyl compounds (e.g., styrene and derivatives thereof such as vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic esters, N-vinyl-2-pyrrolidone, N-vinylpyridine and 2- and 4-vinylpyridine.

Of them, acrylic esters, methacrylic esters and maleic esters are preferred. The non-color forming ethylenic monomers may be used as a combination of two or more thereof if desired. For example, a combination of methyl acrylate and butyl acrylate, a combination of butyl acrylate and styrene, a combination of butyl methacrylate and methacrylic acid or a combination of methyl acrylate and diacetone acrylamide can be used.

The ethylenically unsaturated monomers to be copolymerized with the vinyl monomers corresponding to the compounds of general formula (I), (II) or (III) can be chosen so that the physical properties and/or chemical properties (e.g., solubility) of the resulting copolymers have a good effect on the compatibility thereof with a binder such as gelatin in photographic colloid compositions, flexibility, thermal stability, etc. as is well known by those skilled in the art of the polymer couplers.

It is preferred that the cyan couplers of the present invention are present in the red-sensitive silver halide emulsion layers of silver halide photographic materials. More specifically, it is preferred that the cyan couplers of the present invention are used as an incorporated coupler. Accordingly, it is preferred that at least one of $R_1$, $R_2$, $R_3$, $R_4$ and X is a ballast group (having preferably at least 10 carbon atoms in total). More preferably, the sum total of carbon atoms is 10 to 50. It is particularly preferred that $R_3$ or $R_4$ is a ballast group.

Examples of the couplers of the present invention include, but are not limited to, the following compounds.

C-1)

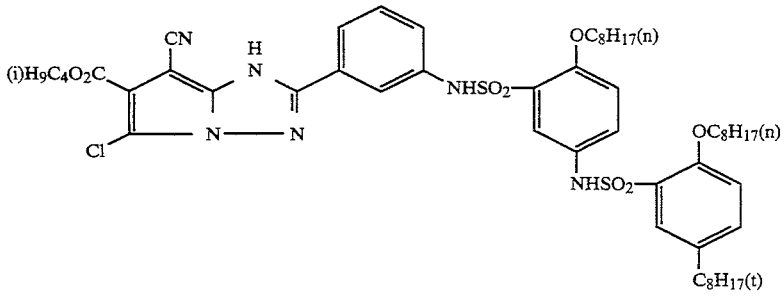

C-2)

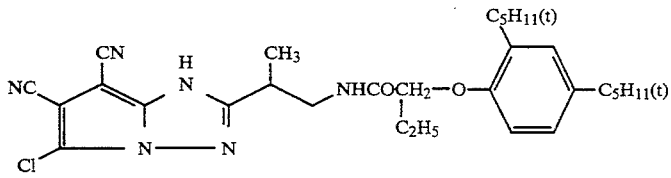

-continued
C-3)
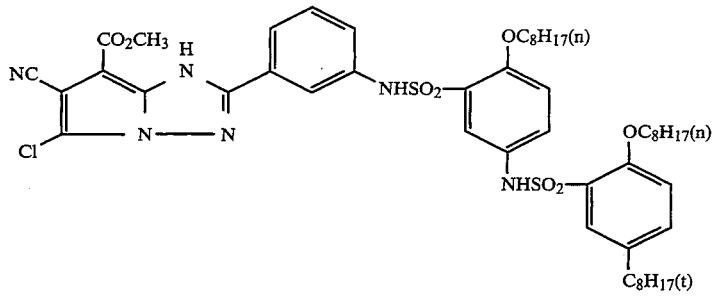
C-4)
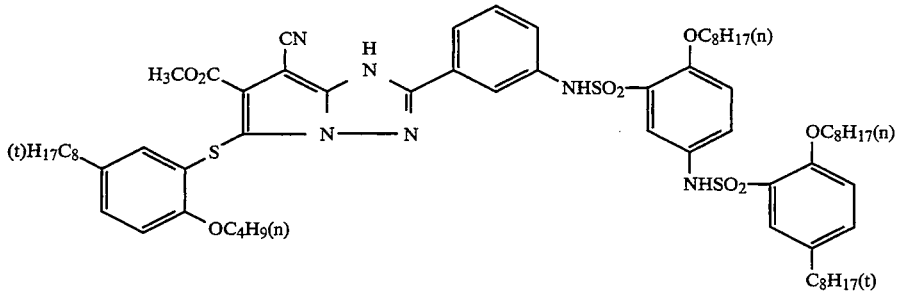
C-5)
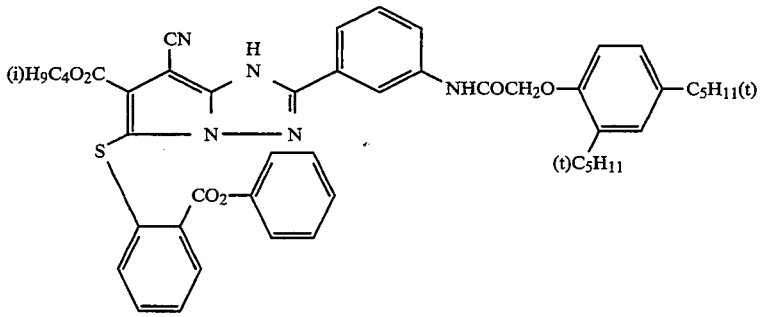
C-6)
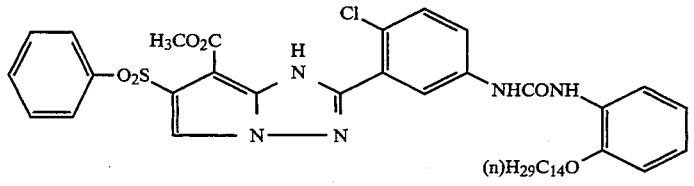
C-7)
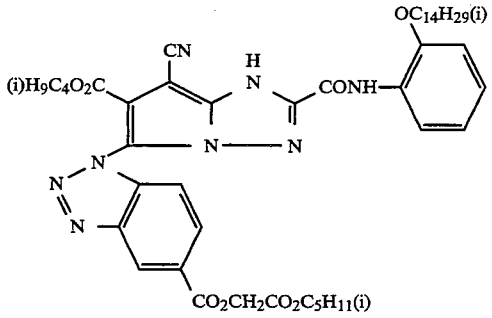
C-8)
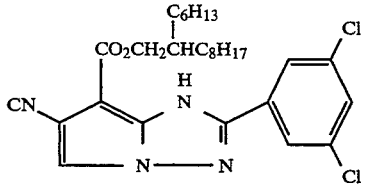

-continued
C-9)
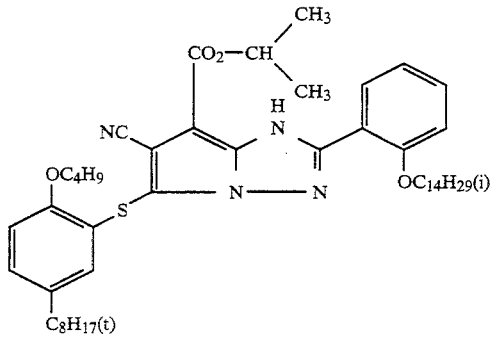
C-10)
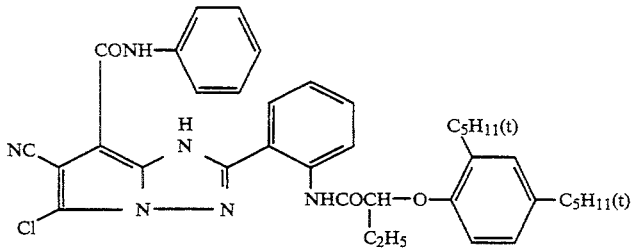
C-11)
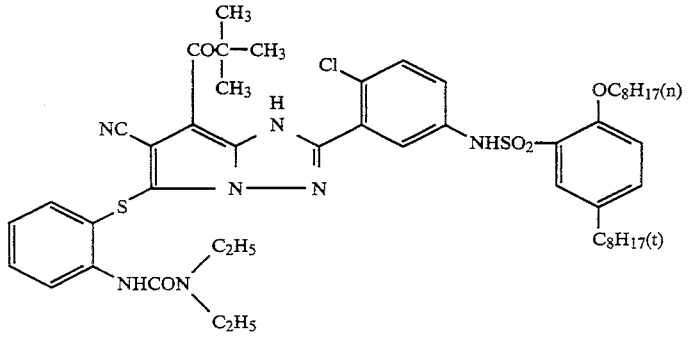
C-12)
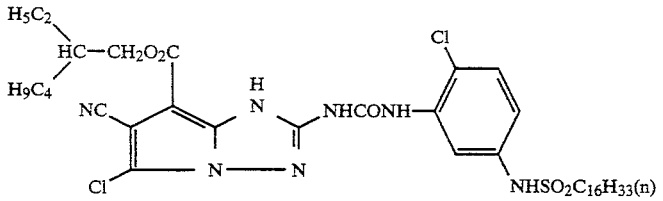
C-13)
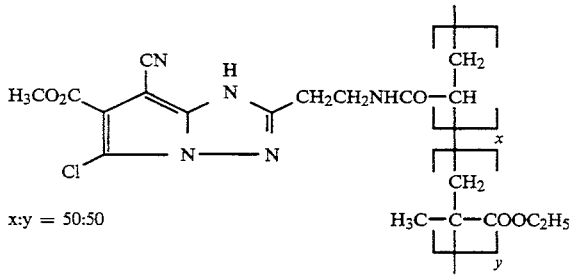
x:y = 50:50

-continued
C-14)
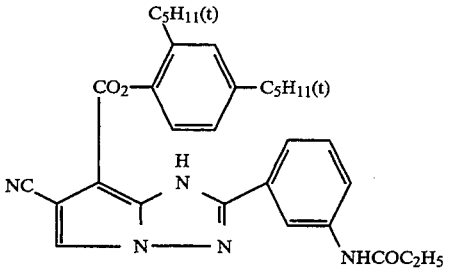
C-15)
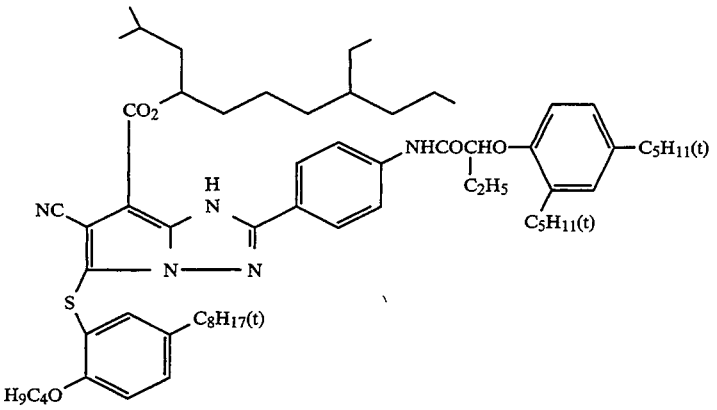
C-16)
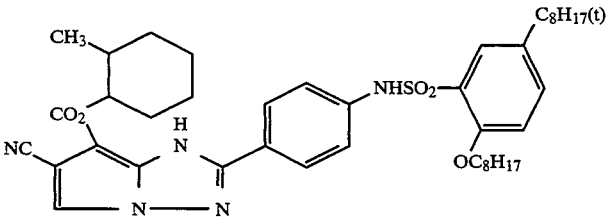
C-17)
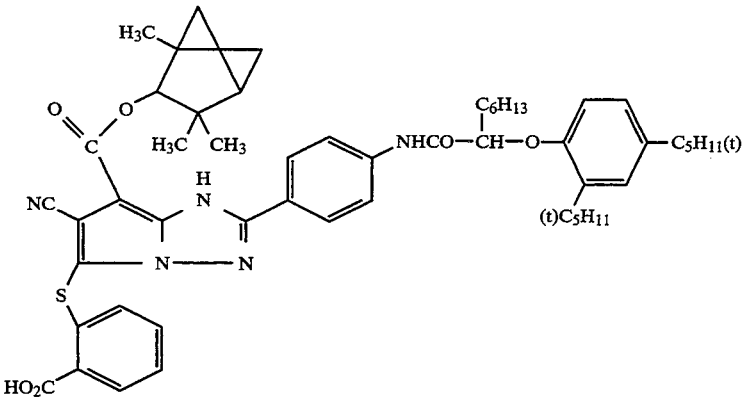

-continued
C-18)
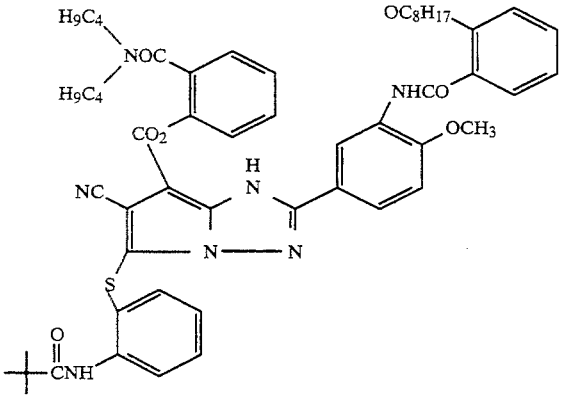
C-19)
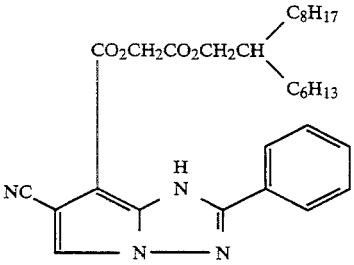
C-20)
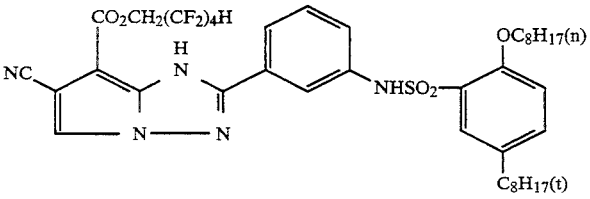
C-21)
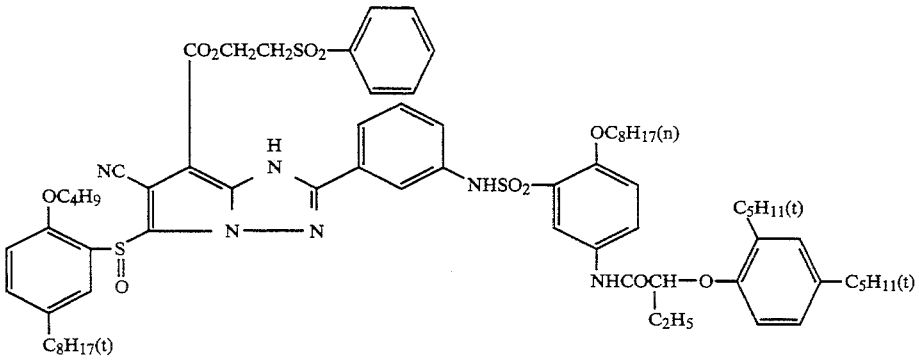
C-22)
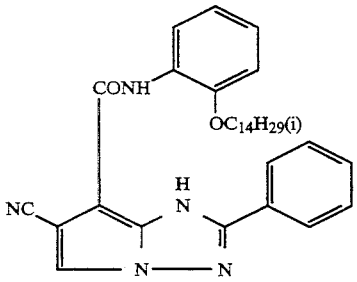

-continued
C-23)
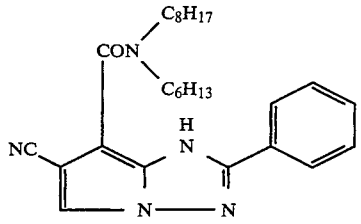
C-24)
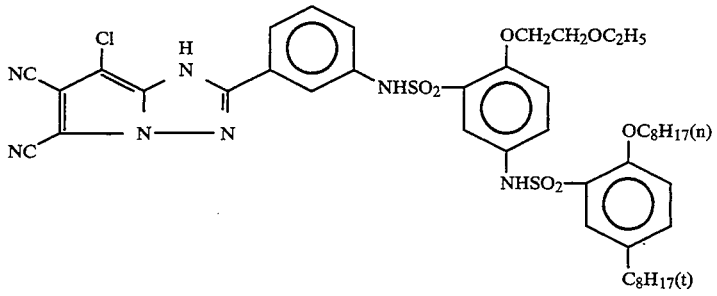
C-25)
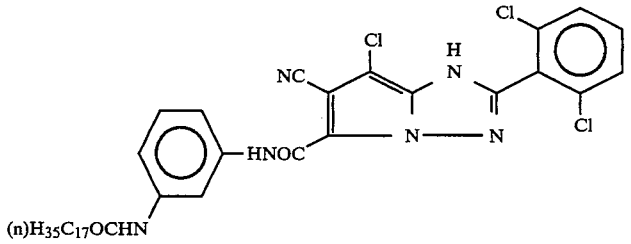
C-26)
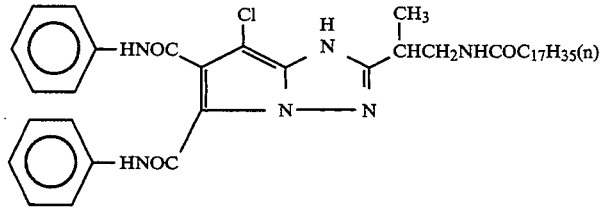
C-27)
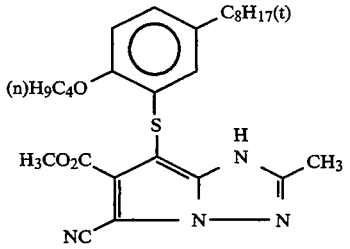
C-28)
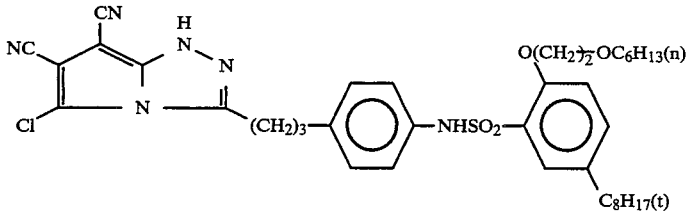

-continued
C-29)
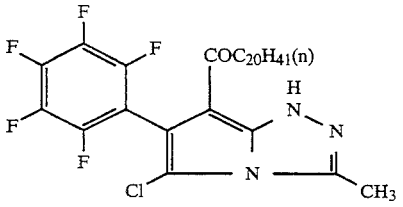
C-30)
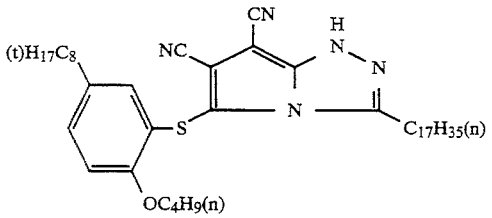
C-31)
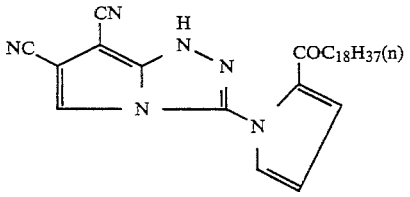
C-32)
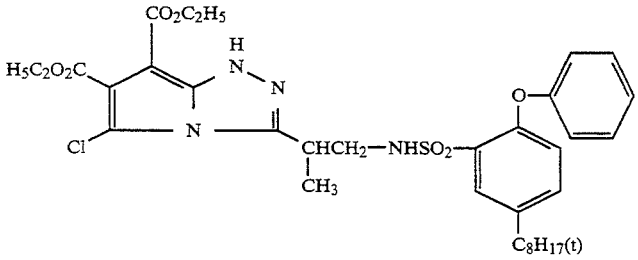
C-33)
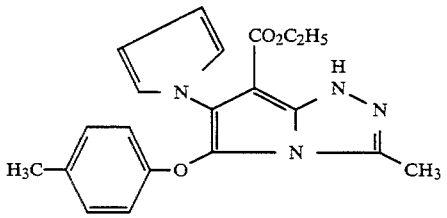
C-34)
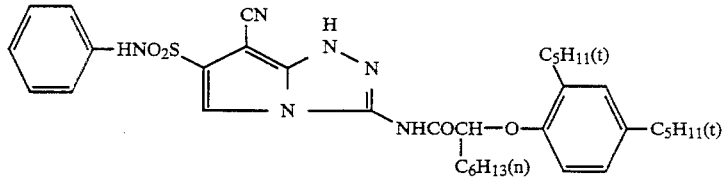
C-35)
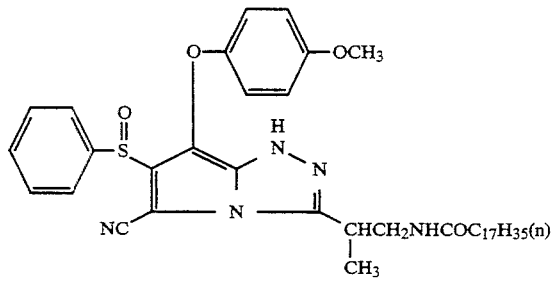

-continued
C-36)
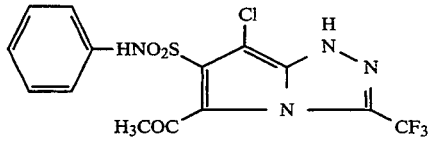
C-37)
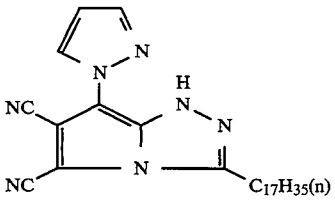
C-38)
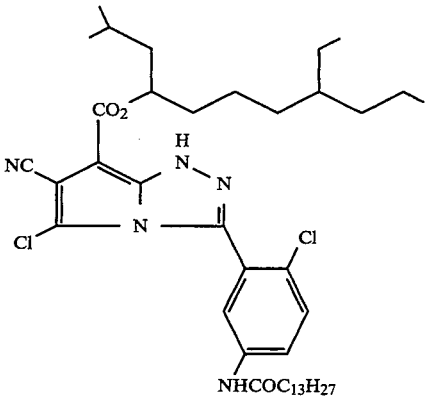
C-39)
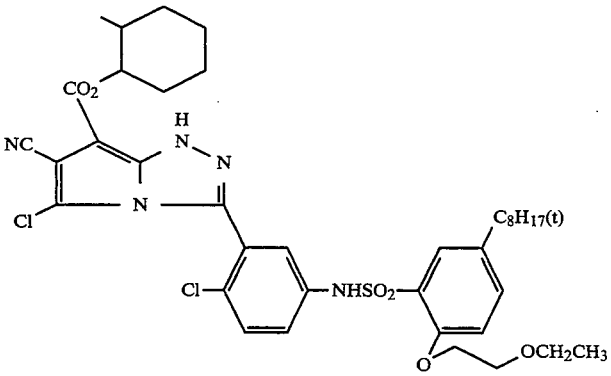
C-40)
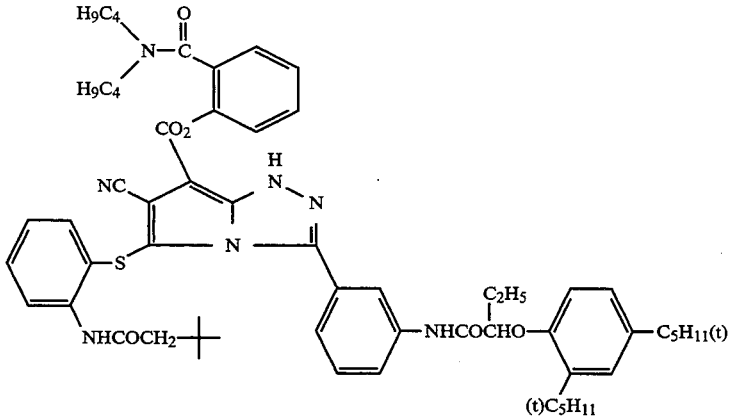

-continued
C-41)
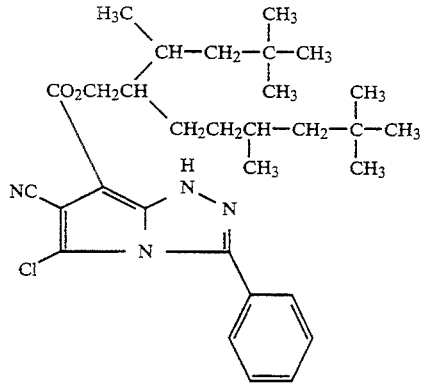
C-42)
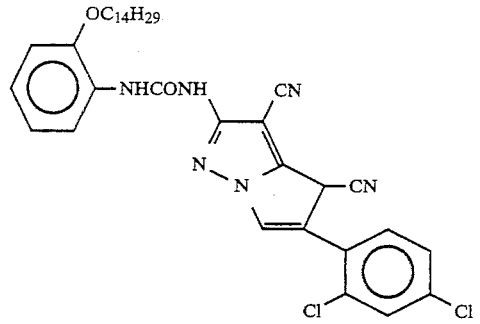
C-43)
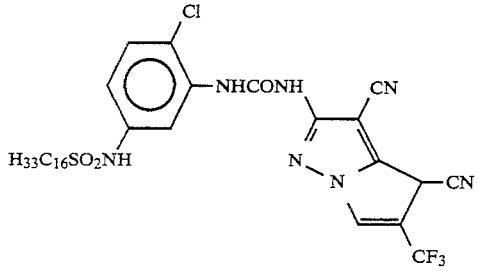
C-44)
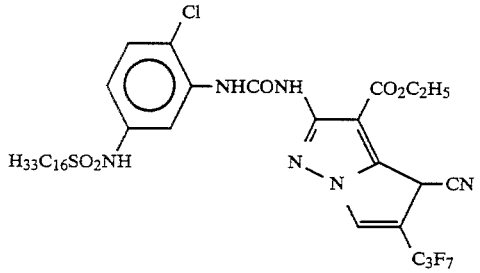
C-45)
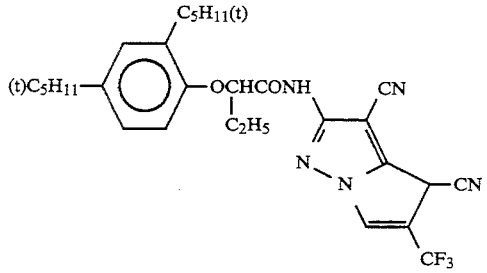

-continued
C-46)
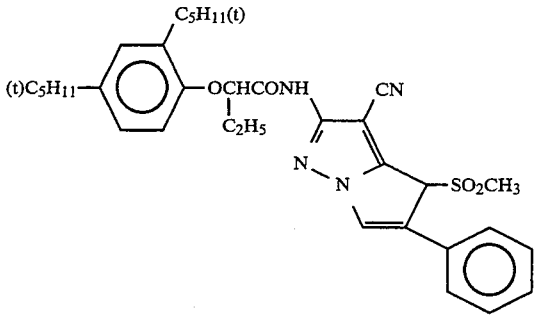
C-47)
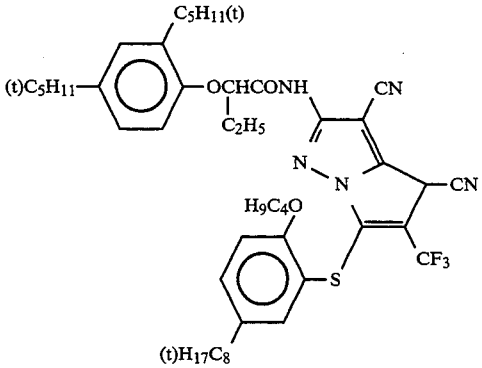
C-48)
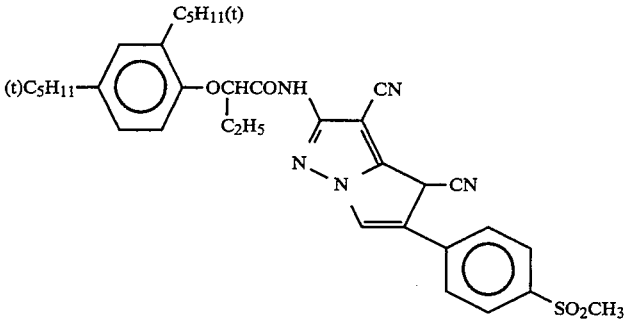
C-49)
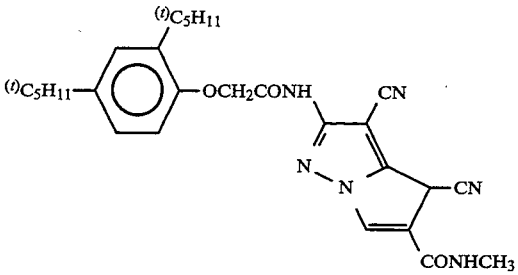
C-50)
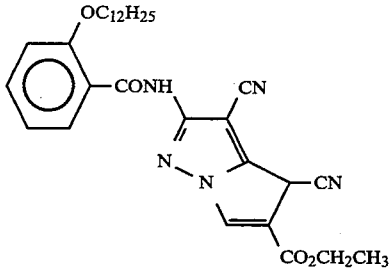
The synthesis of the cyan couplers of the present invention is illustrated below. Unless otherwise indicated herein, all parts, percents, ratios and the like are by weight.
SYNTHESIS EXAMPLE 1

Synthesis of Compound C-1
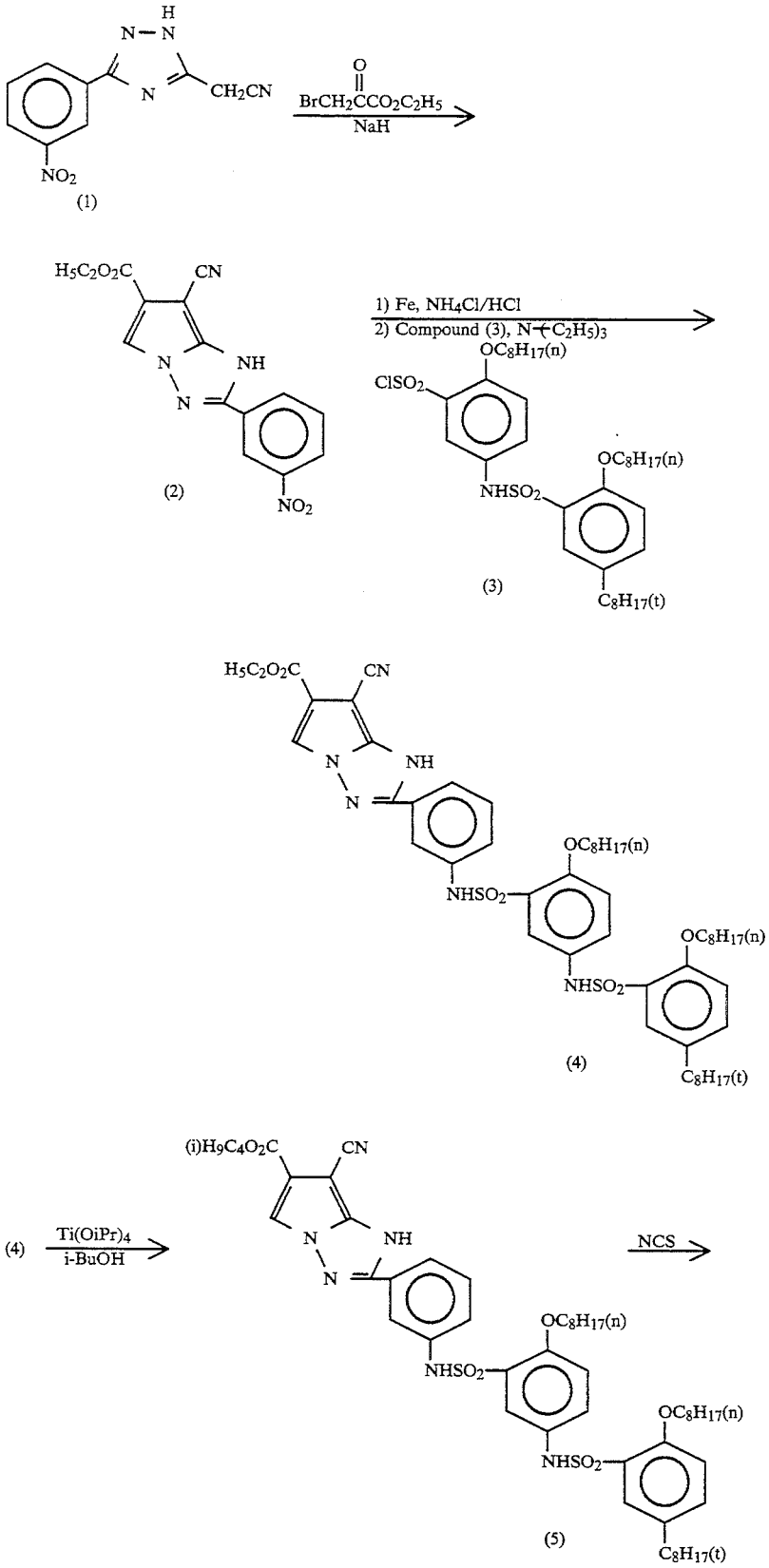

-continued

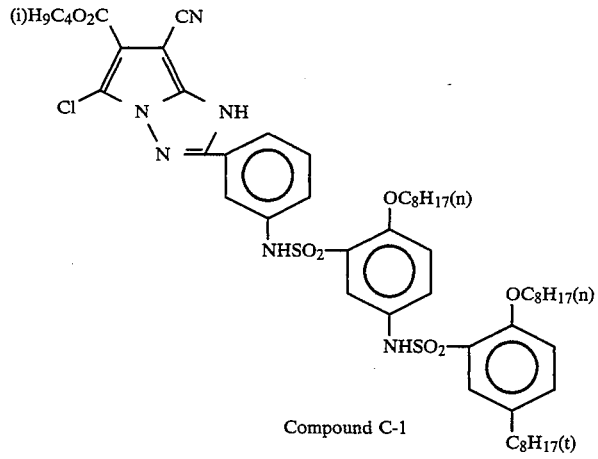

Compound C-1

In 150 ml of dimethylacetamide, there was dissolved 3-m-nitrophenyl-5-methylcyano-1,2,4-triazole (1) (20.0 g, 87.3 mmol). NaH (60% in oil) (7.3 g, 183 mmol) was then added portionwise to the resulting solution, and the mixture was heated. A solution of the ethyl ester of bromopyruvic acid (13.1 ml, 105 mmol) in 50 ml of dimethylacetamide was slowly added dropwise thereto. After the dropwise addition, the mixture was stirred at 80° C. for 30 minutes and then cooled to room temperature (about 20°–30° C.). The reaction mixture was acidified by adding 1N hydrochloric acid, and extracted with ethyl acetate. The extract was dried over sodium sulfate, and the solvent was distilled off. The residue was purified by means of silica gel chromatography to obtain 10.79 g (38%) of Compound (2).

Reduced iron (9.26 g, 166 mmol) and ammonium chloride (0.89 g, 16.6 mmol) were suspended in 300 ml of isopropanol. Further, 30 ml of water and 2 ml of concentrated hydrochloric acid were added thereto, and the mixture was refluxed for 30 minutes. While heating it under reflux, Compound (2) (10.79 g, 33.2 mmol) was added portionwise thereto. Further, the mixture was heated under reflux for 4 hours. Immediately thereafter, the mixture was filtered by using Celite. The filtrate was distilled under reduced pressure. The residue was dissolved in a mixed solvent of 40 ml of dimethylacetamide and 60 ml of ethyl acetate. Compound (3) (25.6 g, 36.5 mmol) was added thereto. Further, triethylamine (23.1 ml, 166 mmol) was added thereto. The mixture was heated at 70° C. for 5 hours. The reaction mixture was cooled to room temperature, and water was added thereto. The mixture was extracted with ethyl acetate. The extract was washed with water and dried over sodium sulfate. The solvent was distilled off under reduced pressure. The residue was purified by means of silica gel chromatography to obtain 16.5 g (52%) of Compound (4).

Compound (4) (7.0 g, 7.30 mmol) was dissolved in 14 ml of isobutanol. Subsequently, tetraisopropyl orthotitanate (0.43 ml, 1.46 mmol) was added thereto, and the mixture was heated at reflux for 6 hours. The reaction mixture was cooled to room temperature, and water was added thereto. The mixture was extracted with ethyl acetate, and the extract was dried over sodium sulfate. The solvent was distilled off under reduced pressure. The residue was purified by means of silica gel chromatography to obtain 5.0 g (69%) of Compound (5).

Compound (5) (5.0 g, 5.04 mmol) was dissolved in 50 ml of tetrahydrofuran. While cooling the resulting solution with water, $SO_2Cl_2$ (0.40 ml, 5.04 mmol) was added dropwise thereto. After completion of the addition, the mixture was stirred for additional 4 hours while cooling it with water. To the reaction mixture, water was added, and the mixture was extracted with ethyl acetate. The extract was dried over sodium sulfate. The solvent was distilled off under reduced pressure. The residue was purified by means of silica gel chromatography. 3.9 g (76%) of Compound C-1 was obtained.

SYNTHESIS EXAMPLE 2

Synthesis of Compound C-28

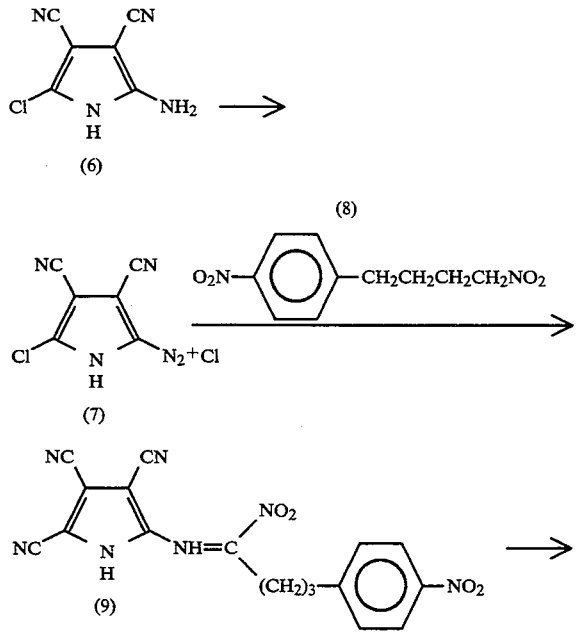

-continued

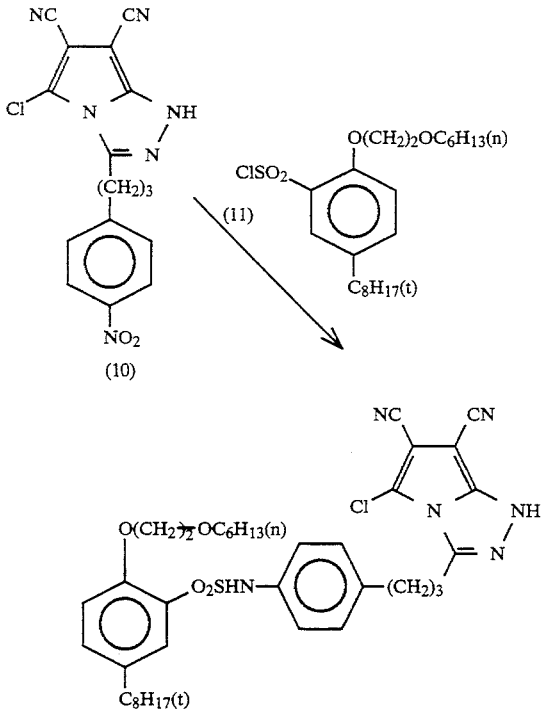

Compound C-28

To 2-amino-5-chloro-3,4-dicyanopyrrole (6) (6.78 g, 40.7 mmol), there was added 38 ml of 36% hydrochloric acid. While stirring the resulting solution under cooling with ice, a solution of sodium nitrite (2.95 g, 42.7 mmol) in 5.9 ml of water was slowly added dropwise thereto, and the mixture as such was continuously stirred for 1.5 hours to synthesize Compound (7). Separately, 102 ml of 28% sodium methylate was added to a solution of Compound (8) (9.58 g, 427 mmol) in 177 ml of ethanol while stirring it under cooling with ice to prepare a solution. To the resulting solution, there was slowly added dropwise the solution of Compound (7) synthesized above while stirring the resulting solution under cooling with ice. After the addition, stirring was continued for one hour. The reaction mixture was heated under reflux with stirring for 1.5 hours. Ethanol was distilled off from the reaction mixture under reduced pressure. The residue was dissolved in chloroform, washed with saturated sodium chloride and dried over sodium sulfate. Chloroform was then distilled off under reduced pressure. The residue was purified by means of silica gel column chromatography to obtain 4.19 g [29% based on Compound (6)] of Compound (10).

Compound (6) was synthesized by chlorinating 3,4-dicyanopyrrole, nitrating the product and reducing the nitro compound with iron Compound (8) was synthesized from Compound (a) (which was synthesized from γ-lactone and benzene by a conventional method) according to the method described in *Journal of the American Chemical Society,* 76, 3209 (1954).

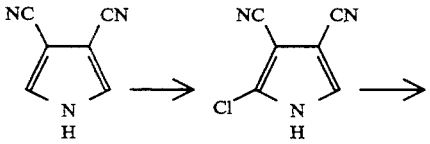

-continued

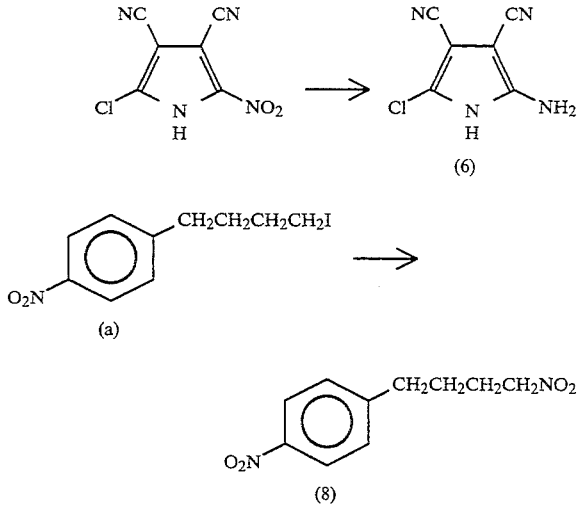

To reduced iron powder (3.3 g, 59.0 mmol), there were added 10 ml of water, ammonium chloride (0.3 g, 5.9 mmol) and acetic acid (0.34 ml, 5.9 mmol). After the mixture was refluxed with stirring for 15 minutes, 31 ml of isopropanol was added thereto. The mixture was heated at reflux with stirring for an additional 20 minutes. A solution of Compound (10) (4.1 g, 11.8 mmol) in 14 ml of isopropanol was then added dropwise thereto. The mixture was heated under reflux with stirring for 2 hours, and the reaction mixture was filtered using Celite as a filtration aid. The residue was washed with ethyl acetate, and the solvent was distilled off under reduced pressure.

The residue was dissolved in a mixed solution of 16 ml of ethyl acetate and 24 ml of dimethylacetamide. Compound (11) (5.6 g, 13.0 mmol) was added thereto. Further, triethylamine (8.2 ml, 59.0 mmol) was added thereto. The mixture was stirred at room temperature for 4 hours. Water was added thereto, and the mixture was extracted with ethyl acetate. The extract was washed with saturated sodium chloride and dried over sodium sulfate. The solvent was distilled off under reduced pressure. The residue was purified by means of silica gel chromatography to obtain 6.46 g (76%) of Compound C-28.

Other couplers can be synthesized in the same manner as described above.

The compounds of general formula (H) are in more detail below.

The aliphatic group represented by $R^6$ and $R^7$ is a straight-chain, branched or cyclic alkyl group having 1 to 30 carbon atoms, an aralkyl group, an alkenyl group or an alkynyl group. The alkyl group is a straightchain, branched or cyclic alkyl group having 1 to 30 carbon atoms and includes methyl, cyclohexyl, 2-octayl and octadecyl. The aralkyl group has 7 to 30 carbon atoms and includes benzyl, phenethyl and trityl.

The alkenyl group has 2 to 30 carbon atoms and include vinyl and 1-dodecenyl. The alkynyl group has 2 to 30 carbon atoms and includes ethynyl, octynyl and phenylethynyl. The aromatic group represented by $R^6$ and $R^7$ is an aryl group having 6 to 30 carbon atoms and includes phenyl and naphthyl. The heterocyclic group represented by $R^6$ and $R^7$ is a saturated or unsaturated monocyclic or fused-ring heterocyclic group. Examples thereof include pyridyl, imidazolyl, thiazolyl, quinolyl, morpholino and thienyl.

The hydrazino group represented by $R^6$ includes $R^7N(R^8)$—$N(R^5)$— in general formula (H).

$R^8$, $R^9$, $R^5$ are each a group which can be eliminated under alkaline conditions (preferably at a pH of not lower than 9.0, more preferably at a pH of not lower than 10.0) and which has not less than 20 carbon atoms. Examples of such groups include an alkylsulfonyl group, an arylsulfonyl group, an acyl group, a dialkylaminomethyl group and a hydroxymethyl group. Examples of alkyl group represented by $R^5$ include those already described above in the definition of $R^7$. Preferably, $R^8$, $R^9$ and $R^5$ are each a hydrogen atom.

The alkyl group represented by $R^{10}$, $R^{11}$ and $R^{12}$ has 1 to 20 carbon atoms and includes methyl, cyclohexyl and dodecyl. The aryl group represented by $R^{10}$, $R^{11}$, and $R^{12}$ has 6 to 20 carbon atoms and includes phenyl and naphthyl. The above-described groups may be optionally substituted when they can be substituted. Examples of substituents include an alkyl group, an acylamino group, a sulfonylamino group, a ureido group, a urethane group, an alkoxy group, an aryloxy group, a hydroxyl group, a carboxyl group, an aryl group, a carbamoyl group, a sulfamoyl group, an alkylthio group, an arylthio group, a sulfonyl group, a sulfinyl group, an acyl group, a halogen atom, a cyano group, a heterocyclic group and a sulfo group.

Particularly, when $R^7$ is an aromatic group, the substituent is preferably an electron donating group. Examples thereof include an acylamino group, a sulfonylamino group, a ureido group, a urethane group and an alkoxy group.

The description that the "compounds of general formula (H) are nondiffusing" as used herein means that the compounds have either a ballast group or a group capable of enhancing adsorption to silver halide. The ballast group is a group which has not less than 8 carbon atoms and has relatively inert photographic characteristics. Suitable ballast groups include those conventionally used to stabilize photographic materials such as couplers. Examples of ballast groups include an alkyl group, an alkoxy group, a phenyl group, an alkylphenyl group, a phenoxy group, an alkylphenoxy group, an ether group, a ureido group, an amido group, a urethane group, a sulfonamido group, a thioether group, an ester group, a sulfonyl group, an acyl group and combinations thereof.

In this case, compounds having a polar group as a substituent group are more preferred. Polar groups are groups such that the groups alone or in combination have $\pi$ value [defined by C. Hansh et al, *Journal of Organic Chemistry,* vol. 11, pp. 1207–1216 (1973)] of smaller than −1.0. Examples of polar groups include a hydroxy group, a sulfonamido group, an amino group, a carboxyl group, a carbamoyl group, a sulfamoyl group, a ureido group and a heterocyclic group. When the compounds have a ballast group, the molecular weight of the compounds of the general formula (H) is in the range of 300 to 1500, preferably 450 to 1500, more preferably 500 to 800.

Examples of group capable of enhancing adsorption on the surface of silver halide include groups such as a thiourea group, a heterocyclic thioamido group, a mercapto heterocyclic group and an azole group described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-60-179734, JP-A-61-170733 and JP-A-62-948.

Preferred groups are a non-cyclic thioamido group (e.g., thioureido, thiourethane), a cyclic thioamido group (e.g., mercapto group-substituted nitrogen-containing heterocyclic ring such as 2-mercaptothiadiazole, 3-mercapto-1,2,4-triazole, 5-mercaptotetrazole, 2-mercapto-1,3,4-oxadiazole, 2-mercaptobenzoxazole) and a nitrogen containing heterocyclic group (e.g., benztriazole, benzimidazole, indazole).

As the nondiffusing group, a ballast group is preferable to a group capable of enhancing adsorption on the surface of silver halide.

Examples of groups represented by $—(G)_m—$ in the general formula (H) include —CO—, —COCO—, $—SO_2—$, —SO—, $—CON(R^{10})—$, —COO—, $—CO-CON(R^{10})$, —COCOO—, $—SO_2N(R^{11})—$, —C(=S)— and an iminomethylene group. Among them, —CO—, —COCO—, $—SO_2—$, $—CON(R^{10})—$ and —COO— are preferred. More preferred are —CO—, —COCO—, $—CON(R^{10})—$ and —COO—. Most preferred is —CO—.

Of the compounds of general formula (H), compounds represented by the following general formulas (H-I) to (H-IV) and polymers comprising a repeating unit represented by the following general formula (H-V) are preferred.

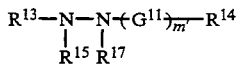
(H-I)

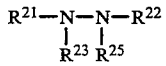
(H-II)

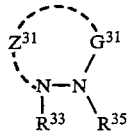
(H-III)

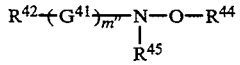
(H-IV)

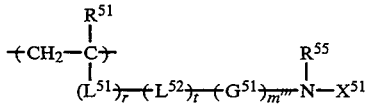
(H-V)

wherein $R^{13}$ and $R^{21}$ have the same meaning as $R^7$ in general formula (H) ; $G^{11}$, $G^{31}$, $G^{41}$ and $G^{51}$, have the same meaning as G; $R^{15}$, $R^{23}$ and $R^{33}$ have the same meaning as $R^8$; $R^{44}$ has the same meaning as $R^9$; $R^{17}$, $R^{25}$, $R^{35}$, $R^{45}$ and $R^{55}$ have the same meaning as $R^5$; m', m'' and m''' have the same meaning as m; $X^{51}$ has the same meaning as X; $R^{14}$ represents a hydrogen atom, an aliphatic group, an aromatic group, a heterocyclic group or a hydrazino group; $R^{22}$ represents a cyano group, a nitro group, a perfluoroalkyl group (having 1 to 30 carbon atoms, e.g., trifluoromethyl perfluoromethyl) or a heterocyclic group; and $R^{42}$ represents an aliphatic group, an aromatic group or a heterocyclic group. $Z^{31}$ in general formula (H-III) represents a non-metallic atomic group required for forming a four-membered to eight-membered ring. Examples thereof include bivalent bonding groups such as methylene, ethylene, trimethylene, —CO—, 1,2-phenylene, —O—, —S—, —NH—, —NHNH— and combinations thereof. The ring is preferably a five-membered to eight-membered ring.

In general formula (H-V), $R^{51}$ represents a hydrogen atom, a halogen atom or an alkyl group; $L^{51}$ represents —CO—, —$SO_2$—, —NH—, —O—, —S—, phenylene, an alkylene group or a bivalent bonding group composed of a combination thereof; $L^{52}$ represents a bivalent group formed by removing hydrogen atom from $R^7$ in general formula (H); and r and t each represents 0 or 1.

Of the compounds of general formulas (H-I) to (H-V), compounds represented by the following general formula (H-VI) are more preferred.

$$R^{61}-\underset{H}{N}-\underset{H}{N}-G^{61}-R^{62} \qquad \text{(H-VI)}$$

wherein $R^{61}$ represents an aromatic group; $R^{62}$ represents an aliphatic group, an aromatic group or a heterocyclic group; $G^{61}$ represents —CO—, —COCO—, —CON($R^{66}$)— or —COO—; $R^{66}$ has the same meaning as $R^{10}$ in general formula (H); and $R^{61}$ or $R^{66}$ includes a ballast group.

Compounds represented by the following general formula (H-VII) are most preferred.

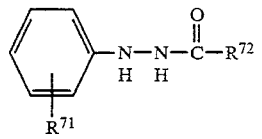

(H-VII)

wherein $R^{71}$ is a substituent on the benzene ring. Examples thereof include those already described above in the definition of the substituents of $R^7$ in general formula (H). Electron donating groups (e.g., acylamino, ureido, sulfonylamino, alkoxy) are particularly preferred. $R^{72}$ represents an aliphatic group or an aromatic group; and any one of $R^{71}$ and $R^{72}$ has a ballast group having not less than 8 carbon atoms. It is preferred that $R^{71}$ or $R^{72}$ has a polar group.

Examples of the compounds of general formula (H) include, but are not limited to, the following compounds.

H-1

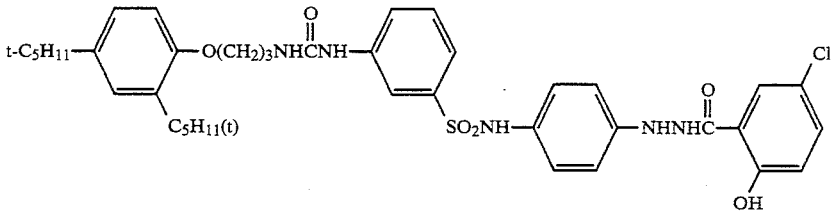

H-2

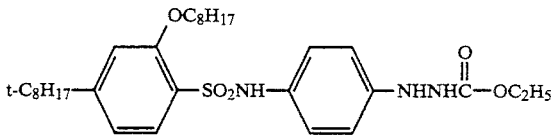

H-3

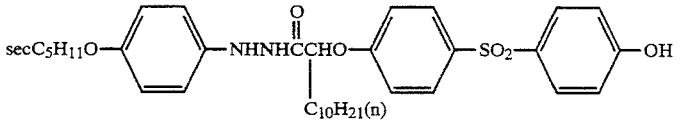

H-4

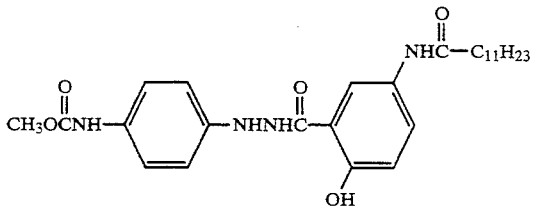

H-5

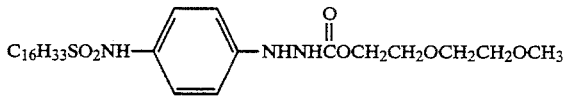

H-6

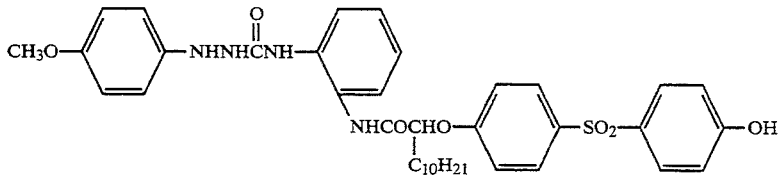

-continued
H-7
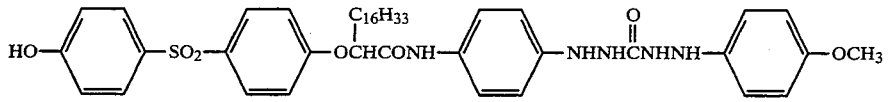
H-8
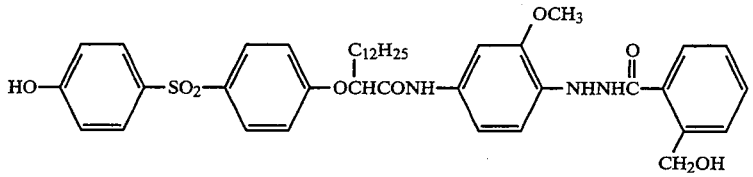
H-9
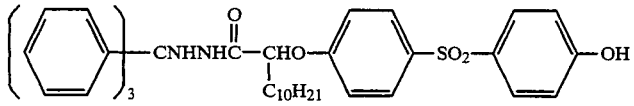
H-10
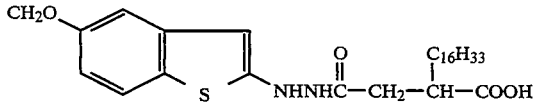
H-11
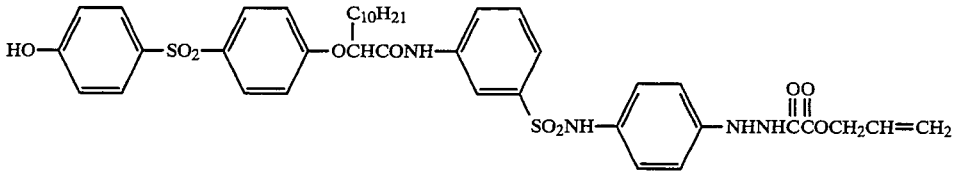
H-12
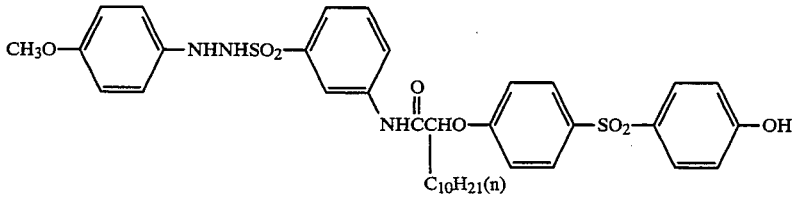
H-13
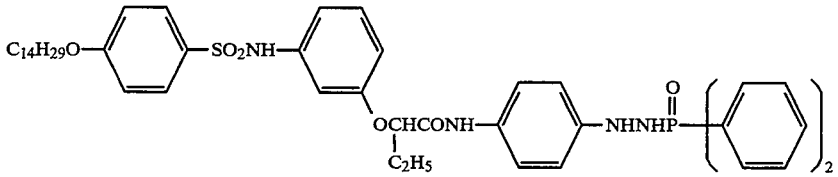
H-14
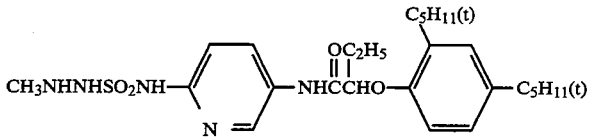
H-15
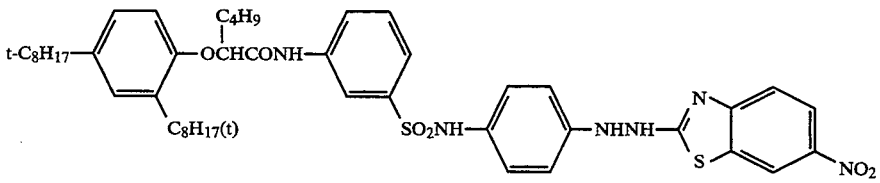

-continued
H-16
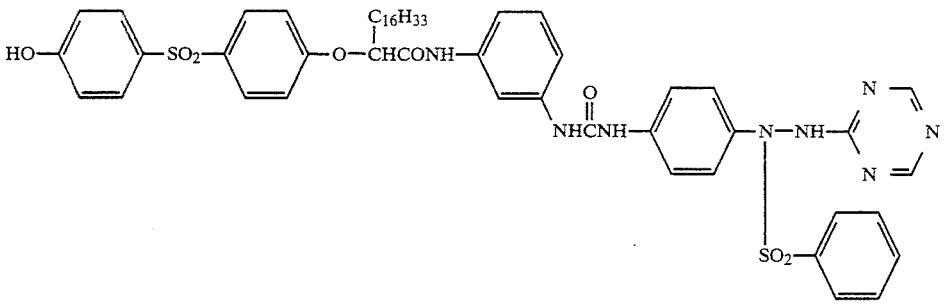
H-17
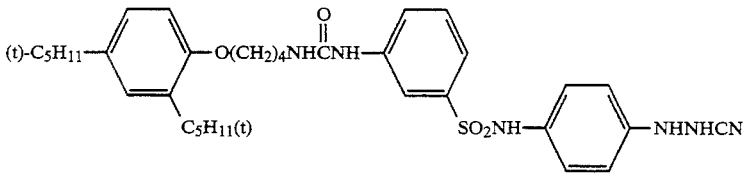
H-18
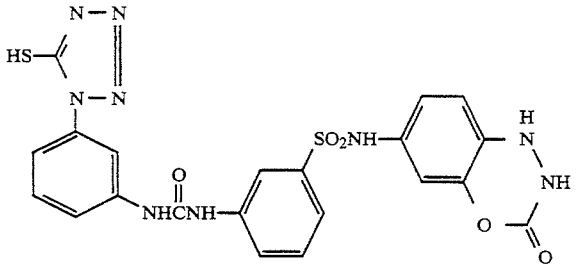
H-19
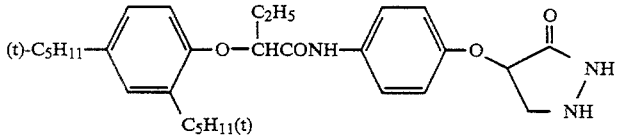
H-20
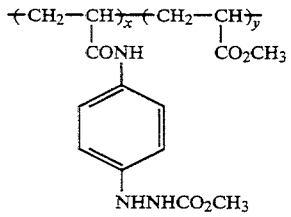
x:y = 1/1
H-21
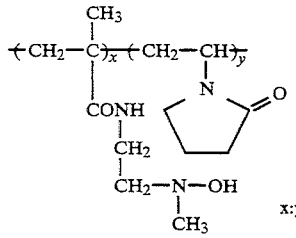
x:y = 3/1
H-22
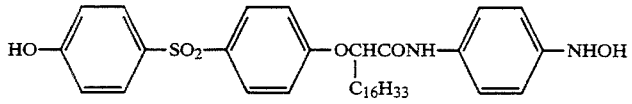
H-23
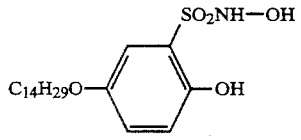

-continued
H-24
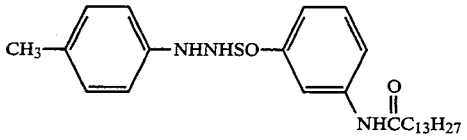
H-25
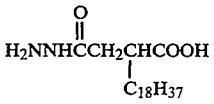
H-26
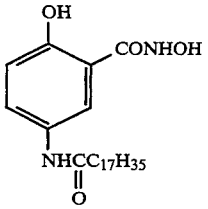
H-27
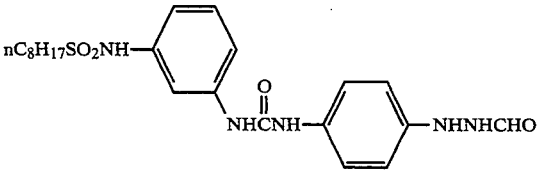
H-28
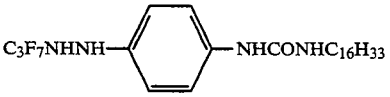
H-29
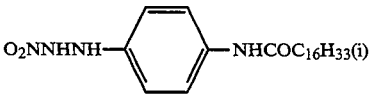
H-30
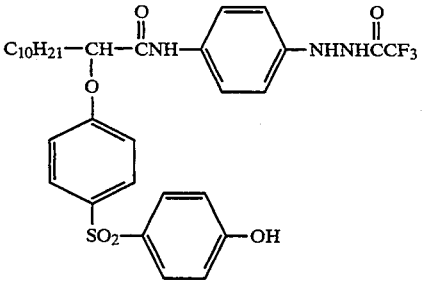
H-31
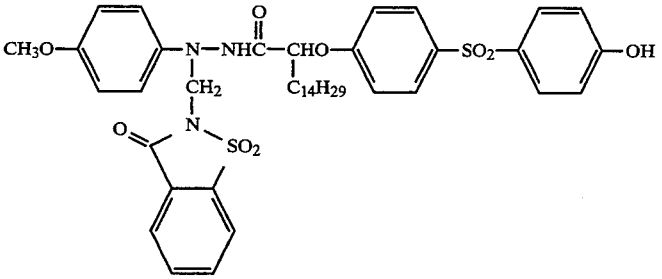

-continued

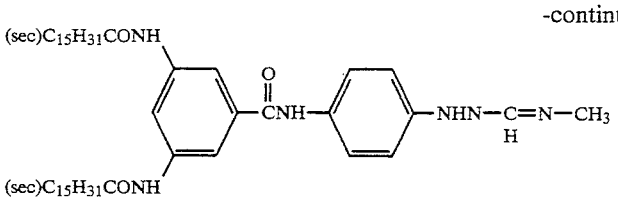

H-32

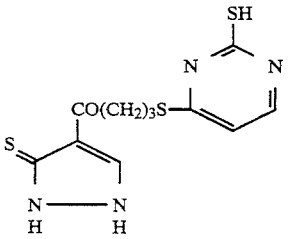

H-33

Other examples of the compounds of general formula (H) in addition to the above-exemplified compounds and synthesis of the compounds of general formula (H) are described in, for example, JP-A-62-27731, JP-A-63-121838, JP-A-63-234245, JP-A-3-164735, JP-A-3-154051, JP-A-3-150560, JP-A-3-150562, JP-A-1-315731, U.S. Pat. No. 4,923,787 and the patent specifications therein, or these compounds can be easily synthesized by reference to the methods described therein.

When the second SPSE Eastern and Western symposium was held (October 1988 Hawaii), a report was made on the compounds of general formula (H) as nondiffusing compounds, for example, compounds which release a development restrainer by the reaction with the oxidation products of developing agents. Further, the compounds are described in JP-A-l-147455 and European Patent 338 785 A to prevent color mixing from occurring.

It is known that some hydrazine compounds of the compounds of general formula (H) according to the present invention have an effect of preventing color mixing from occurring (the effect of preventing color mixing from occurring). However, the degree of the effect obtained thereby is only slightly higher than the degree of the effect of hydroquinone color mixing inhibitors conventionally used for phenol or naphthol cyan couplers. However, when these compounds are used in combination with the pyrroloazole cyan couplers of the present invention, the effect obtained thereby is more remarkable and a high effect is unexpectedly achieved.

Further, the nondiffusing compounds of the present invention have a great effect on improving the properties of the pyrroloazole cyan couplers of the present invention with regard to fading due to heat under high humidity conditions. This effect is an unexpected finding which cannot be predicted from the prior art.

The cyan couplers of the present invention can be used in light-sensitive silver halide emulsion layers or light-insensitive layers adjacent thereto. When the cyan couplers of the present invention are used in the silver halide emulsion layers, the couplers are used in an amount of 0.005 to 1 mol, preferably 0.01 to 0.5 mol, more preferably 0.05 to 0.4 mol per mol of silver halide. When the cyan couplers of the present invention are used in light-insensitive layers, the couplers are used in an amount of 0.001 to 2 mol, preferably 0.02 to 0.5 mol per mol of silver halide in the silver halide emulsion layer.

The cyan couplers of the present invention can be used together with conventional phenol cyan couplers or naphthol cyan couplers. In this case, it is preferred that the amount of cyan coupler of the present invention accounts for at least 25% of the total amount of the cyan couplers to be used. The total amount of the cyan couplers based on the amount of silver halide is in the range described above.

The compounds of general formula (H) according to the present invention can be used in any of the layers provided on the support. More specifically, the compounds can be used in the silver halide emulsion layers as well as in the light-insensitive hydrophilic colloid layers (e.g., a light-insensitive interlayer interposed between two silver halide emulsion layers, protective layers, antihalation layers, or ultraviolet light absorbing layer). In the present invention, it is preferred for the compounds to be present in the silver halide emulsion layers containing the cyan couplers of the present invention or in light-insensitive colloid layers adjacent thereto. It is particularly preferred for the compounds to be present in a light-insensitive interlayer interposed between a silver halide emulsion layer containing the cyan coupler of the present invention and another silver halide emulsion layer.

When the compounds of general formula (H) and the cyan couplers of the present invention are used in the same layer, the compounds are used in an amount of 1 to 0.001 mol, preferably 0.5 to 0.01 mol, more preferably 0.2 to 0.02 mol per mol of cyan coupler.

When the compounds of general formula (H) are used in a light-insensitive interlayer, the compounds are used in an amount of generally 0.001 to 0.8 g/m$^2$, preferably 0.005 to 0.5 g/m$^2$, more preferably 0.01 to 0.3 g/m$^2$.

The compounds of general formula (H) according to the present invention may be used together with conventional color mixing inhibitors (e.g., hindered phenols, hindered amines, ether compounds, amide compounds metal complexes) or conventional anti-fading agents (e.g., hydroquinone compounds or dissolving-out decolorization type couplers).

The light-sensitive material of the present invention may comprises a support having thereon at least one cyan color forming silver halide emulsion layer. Preferably, the light-sensitive material of the present invention comprises a support having thereon at least one yellow color forming silver halide emulsion layer, at least one magenta color forming silver halide emulsion layer and at least one cyan color forming silver halide emulsion layer, these layers are blue-sensitive, green-sensitive and red-sensitive, respectively. These layers can be coated in this order to prepare the light-sensitive material of the present invention. However, the order of these layers may be different from that described above. If desired, an infrared-sensitive silver halide emulsion layer may be used in place of at least one of the above-described light-sensitive emulsion layers.

Any of silver chloride, silver bromide, silver chlorobromide, silver iodochlorobromide and silver iodo-bromide can be used as the silver halide in the present invention. However, it is preferred from the standpoints of the effect of the present invention and rapid processing that silver chloride or silver chlorobromide emulsions having a silver chloride content of at least 90 mol %, preferably at least 95 mol %, particularly preferably at least 98 mol % and containing substantially no silver iodide are used.

It is preferred for the hydrophilic colloid layers of the light-sensitive material of the present invention to contain dyes decolorized upon processing (particularly oxonol dyes) as described in EP 0 337 490 A2 (pp. 27–76) in an amount so as to give an optical density of at least 0.70 at 680 nm, or at least 12 wt % (more preferably at least 14 wt%) of titanium oxide surface treated with a dihydric to tetrahydric alcohol (e.g., trimethylol ethane) is contained in the water-resistant resin layer of the support to improve image sharpness.

It is preferred for the light-sensitive material of the present invention contains the couplers together with dye image preservability improving compounds as described in EP 0 277 589 A2. It is particularly preferred that the dye image preservability improving compounds are used in combination with pyrazoloazole couplers.

More specifically, it is preferred that a compound (F) and/or a compound (G) are/is used, the compound (F) chemically bonding to aromatic amine developing agents left behind after color development to form a compound which is chemically inert and substantially colorless, and the compound (G) chemically bonding to the oxidation product of the aromatic amine color developing agents after color development to form a compound which is chemically inert and substantially colorless. For example, stain can be prevented from being formed by developed dye formed on reaction of the couplers with the color developing agents or the oxidation product left behind during storage after processing, or other side effects can be prevented from occurring.

It is preferred that the hydrophilic colloid layers of the light-sensitive material of the present invention contain antifungal agents as described in JP-A-63-271247 to prevent images from being deteriorated by the growth of mold and bacteria.

Suitable supports for display which can be used in the light-sensitive material of the present invention include a white polyester support or supports having a white pigment-containing layer on the silver halide emulsion layer side thereof. Further, it is preferred that an antihalation layer is provided on the silver halide emulsion layer-coated side of the support or on the back side thereof. Particularly, it is preferred that the transmission density of the support is in the range of 0.35 to 0.8 so as to allow display using reflected light as well as transmitted light.

The light-sensitive material of the present invention may be exposed to visible light or infrared light. Exposure may be to any of a low-illumination exposure and a high-illumination exposure. In the latter case in particular, a laser scanning exposure system wherein the exposure time per pixel is shorter than $10^{-4}$ seconds is preferred.

It is preferred for a band stop filter described in U.S. Pat. No. 4,880,726 to be used in conducting the exposure. When this filter is used, light color mixing can be prevented from occurring, and color reproducibility can be greatly improved.

Silver halide emulsions, other materials (e.g., additives, etc.), photographic layers (e.g., the arrangement of the layers), processing methods and processing additives described in the following patent specifications, particularly European Patent EP 0 355 660 A2 (JP-A-2-139544) can be advantageously applied to the light-sensitive materials of the present invention and the processing thereof.

| Photographic Element | JP-A 62-215272 | JP-A 2-33144 | EP 0 355 660 A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, | From page 91, right upper | From page 3, right upper | Page 4, lines 15 to 27; from |

-continued

| Photographic Element | JP-A 62-215272 | JP-A 2-33144 | EP 0 355 660 A2 |
|---|---|---|---|
| Magenta and Yellow Couplers) | column, line 4 to page 121, left upper column, line 6 | column, line 14 to page 18, left upper column, last line; and from page 30, right upper column, line 6 to page 35, right lower column, line 11 | page 5, line 30 to page 28, last line; page 45, lines 29 to 31; and from page 47, line 23 to page 63, line 50 |
| Coloring Enhancers | From page 121, left lower column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-Fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-Containing Compounds (as antistatic agents, coating aids, lubricants, and anti-blocking agents) | From page 210, left lower column, line 1 to page 222, left lower column, line 5 | From page 25, left upper column, line 1 to page 27, right upper column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps | From page 3, right upper column, line 7 to page 10, | From page 39, left upper column, line 4 to page 42, left | From page 67, line 14 to page 69, line 28 |

-continued

| Photographic Element | JP-A 62-215272 | JP-A 2-33144 | EP 0 355 660 A2 |
|---|---|---|---|
| and additives) | right upper column, line 5 | upper column, last line | |

The citation to JP-A-62-215272 includes the letter of amendment filed on March 16, 1987.

Of the above-mentioned color couplers, the so-called shortwave type yellow couplers as described in JP-A-63-231451, JP-A-63-123047, JP-A-63-241547, JP-A-1-173499, JP-A-1-213648 and JP-A-1-250944 are also preferably used as yellow couplers.

The processing method described in JP-A-2-207250 (left upper column of page 27 to right upper column of page 34) can be advantageously employed in the processing of silver halide color light-sensitive materials containing a high silver chloride emulsion having a silver chloride content of at least 90 mol %.

The present invention is illustrated in greater detail by reference to the following examples which, however, are not to be construed as limiting the present invention in any way. Again, unless otherwise indicated, all parts, percents ratios and the like are by weight.

EXAMPLE 1

Both sides of a paper support was laminated with polyethylene. The surface of the support was subjected to a corona discharge treatment. A gelatin undercoat layer containing sodium dodecylbenzenesulfonate was coated thereon. Further, various photographic layers were coated thereon to prepare a multi-layer color photographic paper having the following layer structure (Sample 001). Coating solutions were prepared in the following manner.

Preparation of Coating Solution for First Layer 130.0 g of yellow coupler (ExY), 32.0 g of color image stabilizer (Cpd-1), 24.5 g of color image stabilizer (Cpd-2) and 8.0 g of color image stabilizer (Cpd-3) were dissolved in 40 g of solvent (Solv-1), 20 g of solvent (Solv-2) and 180 cc of ethyl acetate. The resulting solution was dispersed by emulsification in 1000 g of an aqueous 10% gelatin solution containing 60 ml of 10% sodium dodecylbenzenesulfonate and 10 g of citric acid to obtain Emulsified Dispersion A. On the other hand, a silver chlorobromide Emulsion A (3/7 (by mol of silver) mixture of large-size emulsion A of cubic grains with a mean grain size of 0.88 μm and small-size emulsion A of cubic grains with a mean grain size of 0.70 μm; the variation coefficient of the grain size distribution of the two emulsions was 0.08 and 0.10, respectively; both emulsions had 0.3 mol % of silver bromide locally on a part of the grain surface) was prepared. The emulsion contained the following blue-sensitizing dyes A and B each in an amount of $2.0\times10^{-4}$ mol per mol of silver in the large-size emulsion A and $2.5\times10^{-4}$ mol per mol of silver in the small-size emulsion A. Chemical ripening of the emulsion was effected using sulfur sensitization and gold sensitization. Emulsified Dispersion A as previously prepared and the silver chlorobromide Emulsion A were blended to give a coating solution for the first layer having the composition described below.

Preparation of Coating Solution for Fifth Layer

A solution of 30.0 g of cyan coupler (ExC), 18.0 g of ultraviolet light absorber (UV-2), 15.0 g of dye image stabilizer (Cpd-1), 10.0 g of dye image stabilizer (Cpd-9), 10.0 g of dye image stabilizer (Cpd-10), 1.0 g of dye image stabilizer (Cpd-11), 1.0 g of dye image stabilizer (Cpd-8), 1.0 g of dye image stabilizer (Cpd-6), 20.0 g of solvent ( Solv-6) and 1.0 g of solvent (Solv-1) in 60.0 cc of ethyl acetate was prepared. To the resulting solution, there was added 500 cc of a 20% aqueous solution of gelatin containing 8 cc of sodium dodecylbenzenesulfonate. The mixture was emulsified and dispersed using an ultrasonic homogenizer to prepare an emulsified dispersion. Separately, a silver chlorobromide emulsion ( cubic; a 1:3 (by mol of Ag) mixture of a larger-size emulsion C having a mean grain size of 0.50 μm and a smaller-size emulsion C having a mean grain size of 0.41 μm; a coefficient of variation in grain size distribution of 0.09 and 0.11, respectively; 0.8 mol % of AgBr being localized on a part of the surface of the grain in each size emulsion) was prepared. The following red-sensitive sensitizing dye E was added to the emulsion ($0.9\times10^{-4}$ mol of the dye was added to the larger-size emulsion, and $1.1\times10^{-4}$ mol of the dye was added to the smaller-size emulsion, each amount being per mol of silver). Further, $2.6\times10^{-3}$ mol of the following compound F per mol of silver halide was added thereto. Chemical ripening of the emulsion was carried out by adding a sulfur sensitizing agent and a gold sensitizing agent. The emulsified dispersion prepared above and the red-sensitive silver chlorobromide emulsion were mixed and dissolved, and a coating solution for the Fifth Layer was prepared so as to give the following composition.

Coating solutions for the First Layer through the Fourth Layer, the Sixth Layer and the Seventh Layer were prepared in the same manner as in the preparation of the coating solution for the Fifth Layer. The sodium salt of 1-oxy-3,5-dichloro-S-triazine was used as a hardening agent for gelatin in each layer.

Cpd-14 and Cpd-15 were added to each layer in an amount to give total coating weights of 25.0 mg/m$^2$ and 50 mg/m$^2$, respectively.

The following spectral sensitizing dyes were used in the silver chloride emulsions of light-sensitive emulsion layers.

Blue-Sensitive Emulsion Layer

Sensitizing Dye A

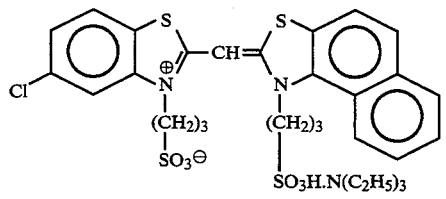

Sensitizing Dye B

-continued

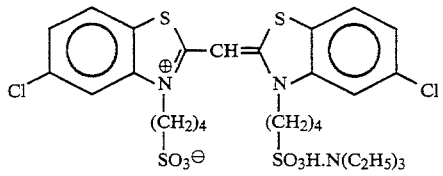

($2.0\times10^{-4}$ mol of each of the dyes added to the large-size emulsion and $2.5\times10^{-4}$ mol of each of the dyes added to the smaller-size emulsion, each amount being per mol of silver halide)

Green-Sensitive Emulsion Layer

Sensitizing Dye C

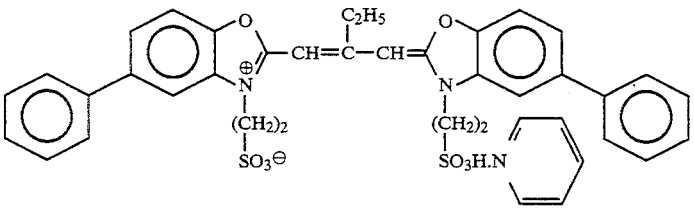

($4.0\times10^{-4}$ mol added to the larger-size emulsion, and $5.6\times10^{-4}$ mol added to the smaller-size emulsion, each amount being per mol of silver halide)

Sensitizing Dye D

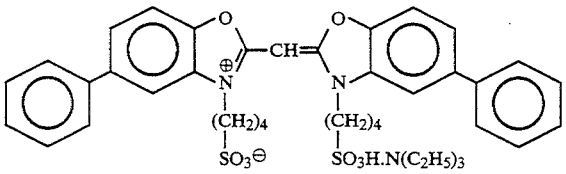

($7.0\times10^{-5}$ mol added to the larger-size emulsion, and $1.0\times10^{-5}$ mol added to the smaller-size emulsion, each amount being per mol of silver halide)

Red-Sensitive Emulsion Layer

Sensitizing Dye E

-continued

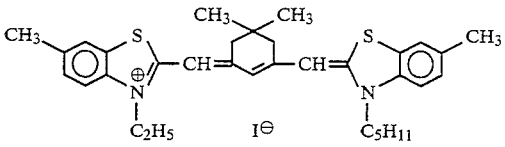

($0.9\times10^{-4}$ added to the larger-size emulsion, and $1.1\times10^{-4}$ mol added to the smaller-size emulsion, each amount being per mol of silver halide).

Further, $2.6\times10^{-3}$ mol of the following compound F per mol of silver halide was added.

Compound F

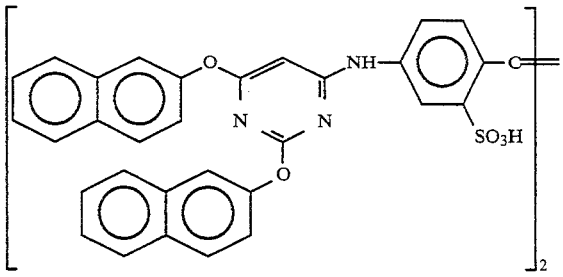

$8.5\times10^{-5}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide.

Further, $1\times10^{-4}$ mol and $2\times10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (the numerals in parentheses being coating weights) were added to the emulsion layers to prevent irradiation.

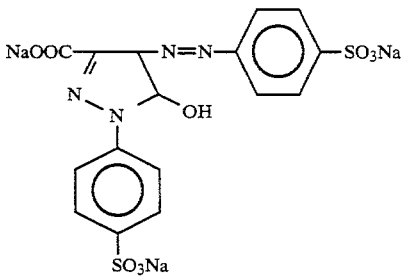

(10 mg/m$^2$)

-continued

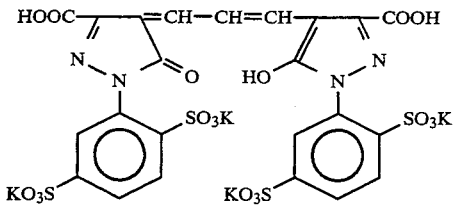

(10 mg/m²)

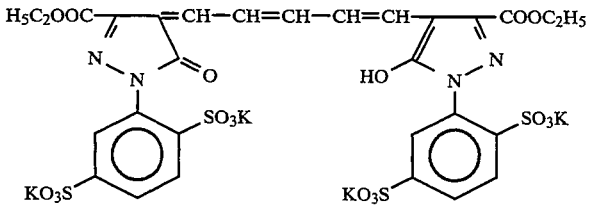

, and (40 mg/m²)

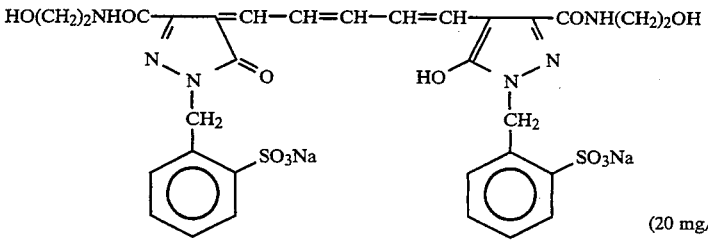

(20 mg/m²)

Layer Structure

Each layer had the following composition. The numerals represent coating weights (g/m²). The amounts of the silver halide emulsions are represented as coating weight in terms of silver.

Support

Polyethylene-laminated paper [Polyethylene on the First Layer side contained a white pigment ($TiO_2$) and a bluish dye (ultramarine)]

| | |
|---|---|
| First Layer (blue-sensitive emulsion layer) | |
| Above described silver chlorobromide emulsion A | 0.27 |
| Gelatin | 1.36 |
| Yellow coupler (ExY) | 0.75 |
| Dye image stabilizer (Cpd-1) | 0.04 |
| Dye image stabilizer (Cpd-2) | 0.02 |
| Dye image stabilizer (Cpd-3) | 0.04 |
| Solvent (Solv-1) | 0.13 |
| Solvent (Solv-2) | 0.13 |
| Second Layer (color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Third Layer (green-sensitive emulsion layer) | |
| Silver chlorobromide emulsion (cubic; a 1:3 (by mol of Ag) mixture of a larger-size emulsion B having a mean grain size of 0.55 μm and a smaller-size emulsion B having a mean grain size of 0.39 μm; a coefficient of variation in grain size distribution: 0.10 and 0.08, respectively; 0.8 mol % of AgBr being localized on a part of the surface of the grain in each size emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |

-continued

| | |
|---|---|
| Fifth Layer (red-sensitive emulsion layer) | |
| Silver chlorobromide (cubic; a 1:3 (by mol of Ag) mixture of a larger-size emulsion C having a mean grain size of 0.50 μm and a smaller-size emulsion C having a mean grain size of 0.41 μm; a coefficient of variation in grain size distribution: 0.09 and 0.11, respectively; 0.8 mol % of AgBr being localized on a part of the surface of the grain in each size emulsion) | 0.18 |
| Gelatin | 0.85 |
| Cyan coupler (ExC) | 0.30 |
| Ultraviolet light absorber (UV-2) | 0.18 |
| Dye image stabilizer (Cpd-1) | 0.15 |
| Dye image stabilizer (Cpd-9) | 0.10 |
| Dye image stabilizer (Cpd-10) | 0.10 |
| Dye image stabilizer (Cpd-11) | 0.01 |
| Solvent (Solv-6) | 0.20 |
| Dye image stabilizer (Cpd-8) | 0.01 |
| Dye image stabilizer (Cpd-6) | 0.01 |
| Solvent (Solv-1) | 0.01 |
| Sixth Layer (ultraviolet absorbing layer) | |
| Gelatin | 0.55 |
| Ultraviolet light absorber (UV-1) | 0.38 |
| Dye image stabilizer (Cpd-12) | 0.15 |
| Dye image stabilizer (Cpd-5) | 0.02 |
| Seventh Layer (protective layer) | |
| Gelatin | 1.13 |
| Acrylic-modified copolymer of polyvinyl alcohol (a degree of modification: 17%) | 0.05 |
| Liquid paraffin | 0.02 |
| Dye image stabilizer (Cpd-13) | 0.01 |

Yellow Coupler (ExY)

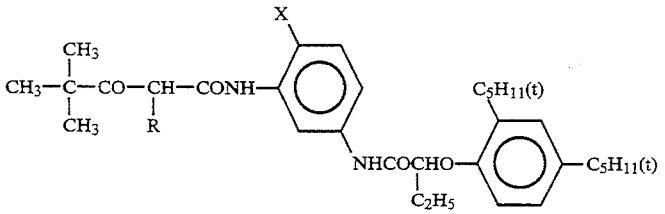

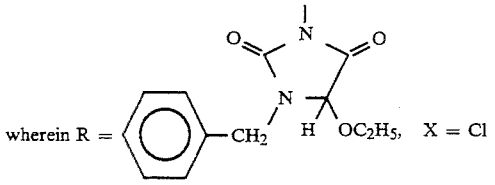

wherein R = and R =

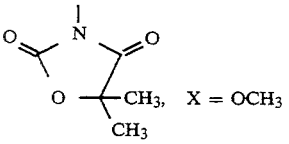

1:1 mixute (by mol)

Magenta Coupler (ExM)

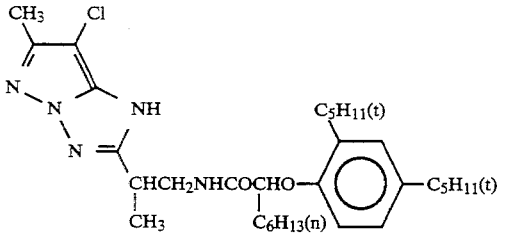

Cyan Coupler (ExC)

-continued
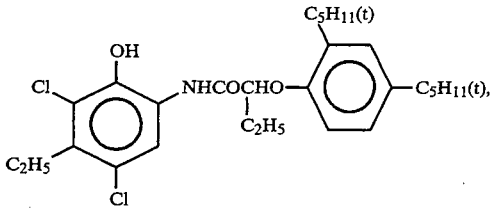
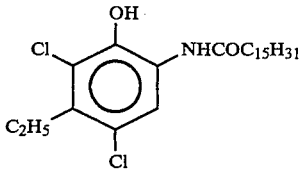
3:7 mixute (by mol)
(Cpd-1) Dye Image Stabilizer
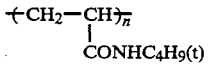
(Average molecular weight: 60,000)
(Cpd-2) Dye Image Stabilizer
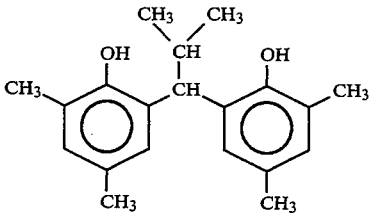
(Cpd-3) Dye Image Stabilizer
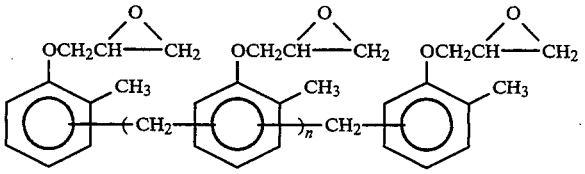
n = 7–8 (mean value)
(Cpd-4) Color Mixing Inhibitor
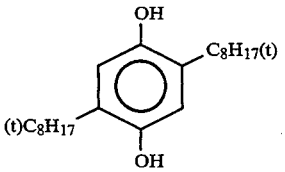
(Cpd-5) Dye Image Stabilizer
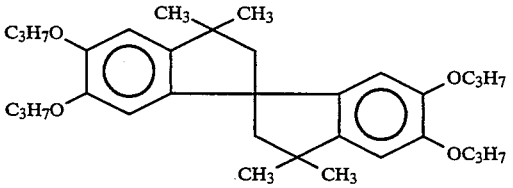
(Cpd-6) Dye Image Stabilizer
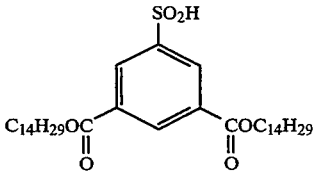

-continued
(Cpd-7) Dye Image Stabilizer
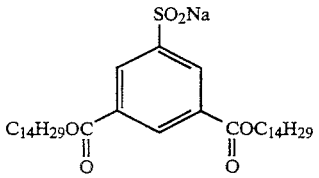
(Cpd-8) Dye Image Stabilizer
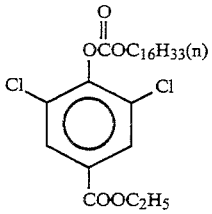
(Cpd-9) Dye Image Stabilizer
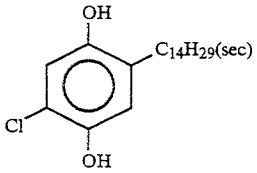
(Cpd-10) Dye Image Stabilizer
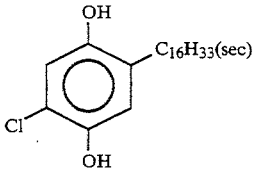
(Cpd-11) Dye Image Stabilizer
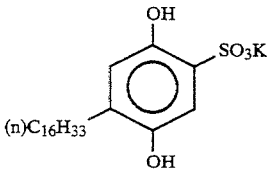
(Cpd-12) Dye Image Stabilizer
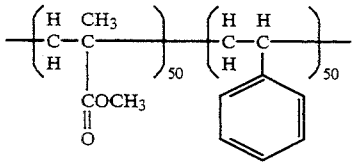
Average molecular weight: 60,000
(Cpd-13) Dye Image Stabilizer
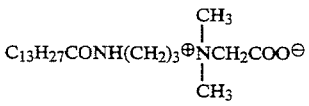
(Cpd-14) Antiseptic
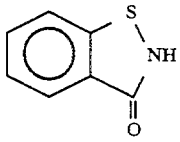

-continued
(Cpd-15) Antiseptic
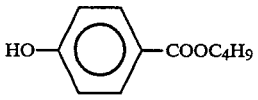
(UV-1) Ultraviolet Light Absorber
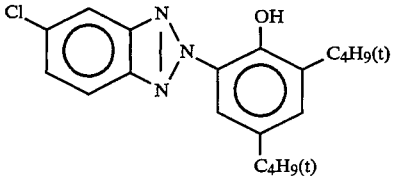
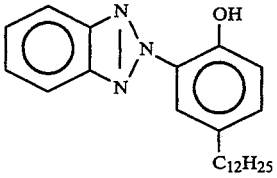
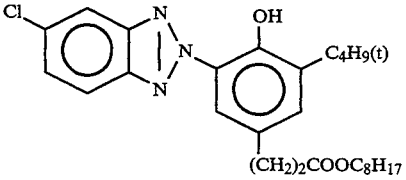
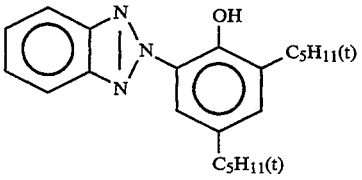
10:5:1:5 mixture (by weight)
(UV-1) Ultraviolet Light Absorber
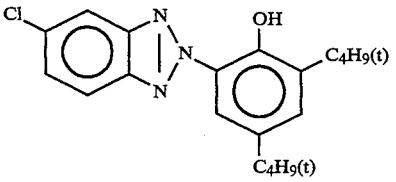
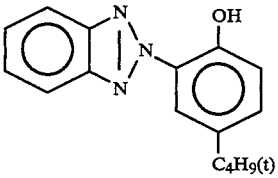
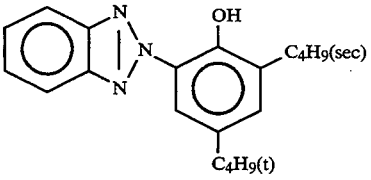
1:2:2 mixture (by weight)
(Solv-1) Solvent -continued $C_8H_{17}CH\underset{O}{\underset{\backslash}{C}}\underset{/}{H}(CH_2)_7COOC_8H_{17}$ (Solv-2) Solvent

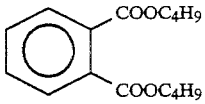

(Solv-3) Solvent

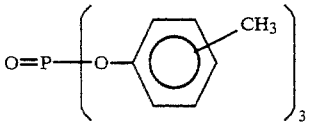

(Solv-4) Solvent

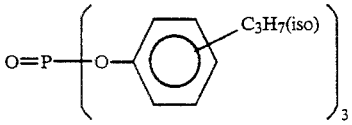

(Solv-5) Solvent $O{=}P{+}OCH_2\overset{C_2H_5}{\overset{|}{C}}HC_4H_9(n))_3$ (Solv-6) Solvent

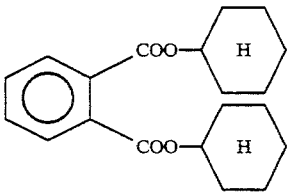

(Solv-7) Solvent

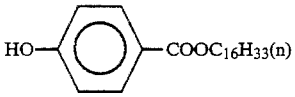

Samples 002 to 054 were prepared in the same manner as in the preparation of the Sample 001 except that an equimolar amount of comparative cyan coupler or the cyan coupler of the present invention was used in place of cyan coupler ExC used in the Fifth Layer of Sample 001, and further the-nondiffusing compound of the present invention was added. The types and amounts of the couplers and the nondiffusing compounds used in these samples are shown in Table A.

Samples 055 to 105 were prepared in the same manner as in the preparation of Sample 001 except that the nondiffusing compound of the present invention was used in place of the color mixing inhibitor (Cpd-4) used in the Fourth Layer of the Sample 001. The types and amounts of the compounds used are shown in Table A below.

Samples 106 to 117 were prepared in the same manner as in the preparation of the Sample 001 except that the nondiffusing compound of the present invention was used in place of the color mixing inhibitor (Cpd-4) used in the Second Layer of the Sample 001. Samples 118 to 121 were prepared in the same manner as in the preparation of Sample 001 except that the nondiffusing compound of the present invention was used in place of the color mixing inhibitor (Cpd-4) used in each of the Second Layer and the Fourth Layer of Sample 001.

Samples 122 to 126 were prepared in the same manner as in the preparation of Sample 001 except that the nondiffusing compound of the present invention was added to the Sixth Layer of Sample 001.

The comparative couplers used are the following compounds had the following structures.

R-1

Compound described in EP 249453

-continued

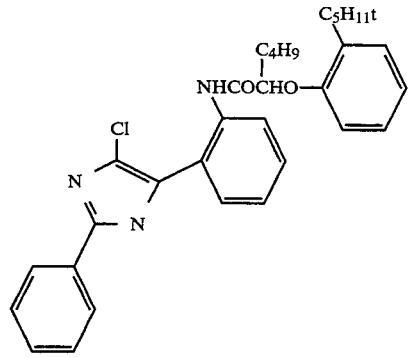

R-2

Compound described in JP-A-64-552

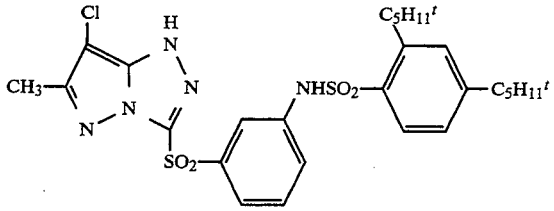

M-1

Compound described in JP-A-62-279340

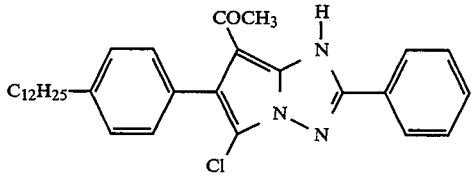

A sensitometer (FWH type manufactured by Fuji Photo Film Co., Ltd., color temperature of light source: 200° K.) was used, and Sample 001 was subjected to gray exposure to achieve about 30% of the amount of coated silver to be developed.

The exposed sample was subjected to continuous processing in the following processing stages by using the following processing solutions and an automatic paper processor to achieve processing at a running equilibrium state.

| Processing Stage | Temperature | Time | Replenisher* | Tank Capacity |
|---|---|---|---|---|
| Color Development | 35° C. | 45 sec. | 161 ml | 17 l |
| Bleaching-Fixing | 30–35° C. | 45 sec. | 215 ml | 17 l |
| Rinse | 30° C. | 90 sec. | 350 ml | 10 l |
| Drying | 70–80° C. | 60 sec. | | |

*Replenishment rate per $m^2$ of the light-sensitive material

| | Tank Solution | Replenisher |
|---|---|---|
| Color Developing Solution | | |
| Water | 800 ml | 800 ml |
| Ethylenediamine-N,N,N',N'-tetramethylenephosphonic acid | 1.5 g | 2.0 g |
| Potassium bromide | 0.015 g | |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium salt of N,N-di(sulfoethyl)hydroxylamine | 4.0 g | 5.0 g |
| Fluorescent brightener (WHITEX 4B, manufactured by Sumitomo Chemical Co., Ltd.) | 1.0 g | 2.0 g |
| Water to make | 1,000 ml | 1,000 ml |
| pH (25° C.) | 10.05 | 10.45 |

| Bleaching-Fixing Solution | Tank solution and replenisher were the same |
|---|---|
| Water | 400 ml |
| Ammonium thiosulfate (700 g/l) | 100 ml |
| Sodium sulfite | 17 g |
| Ammonium ethylenediaminetetraacetato ferrate | 55 g |
| Disodium ethylenediaminetetraacetate | 5 g |
| Ammonium bromide | 40 g |
| Water to make | 1000 ml |
| pH (25° C.) | 6.0 |

Rinsing Water

Tank solution and replenisher were the same

Ion-exchanged water (The concentration of each of calcium ion and magnesium ion being reduced to 3 ppm or less)

Samples 001 to 126 were imagewise exposed through a three-color separation optical wedge and processed using the above-described processing solutions.

The cyan color density of the red color separation exposure area of each of the processed samples was measured, and the maximum color density (Dmax) was read from the sensitometry curve. The red color separation-exposed samples were processed in the same manner as described above, and the measurement of density was made through a red color filter and a green color filter to obtain a sensitometry curve. The green color density at an exposure rate giving a red color density of 1.5 was read from the sensitometry curve, and the value of G/R ratio was determined. AG/R value is shown in Table A below when Sample 001 is referred to as the standard (±0.00). A smaller AG/R value means that the green light absorption of cyan dye image is lower and color purity is higher.

In another evaluation, the samples were subjected to three-color separation exposure. Two sheets of each of the processed samples were prepared and subjected to sensitometry. A fading test was carried out under conditions such that one was stored at 70° C. and 70% RH for one month, and the other was stored in a chamber conditioned at 30° C. and 60% RH under Xe light irradiation (intermittent irradiation with light for 5 hours/-lighting-off for one hour).

The evaluation was made as follows. With regard to fading under high temperature and humidity conditions, the residual ratio of the dye image at an initial cyan color density of 1.0 was represented by % (percentage). With regard to fading by light, the evaluation was made using the residual ratio of the dye image at a yellow color density of 1.5.

The results obtained are shown in Table A below.

TABLE A

| Sample No. | Cyan Coupler | Nondiffusing Compound of Invention Type | Layer (added) | Amount Added | Max. Color Density (Dmax) | ΔG/R Value | Fastness of Cyan Dye Image (at 70° C., 70% RH) (%) | Fastness of Yellow Dye Image to Light (intermittent irradiation of Xe light) (%) | Remarks |
|---|---|---|---|---|---|---|---|---|---|
| 001 | ExC | — | — | — | 1.94 | ±0 | 75 | 60 | Comp. Ex. |
| 002 | R-1 | — | — | — | 1.32 | — | 24 | 59 | " |
| 003 | R-2 | — | — | — | 1.45 | — | 33 | 57 | " |
| 004 | M-1 | — | — | — | 0.29 | — | 52 | 63 | Comp. Ex. magenta coupler |
| 005 | ExC | H-1 | 5th layer | based on amount of coupler 10 mol % | 1.76 | −0.01 | 71 | 62 | Comp. Ex. |
| 006 | " | H-1 | " | 20 mol % | 1.52 | −0.02 | 64 | 64 | " |
| 007 | " | H-3 | " | 10 mol % | 1.74 | −0.01 | 70 | 63 | " |
| 008 | " | H-8 | " | " | 1.72 | −0.02 | 68 | 62 | " |
| 009 | " | H-12 | " | " | 1.79 | −0.01 | 69 | 62 | " |
| 010 | ExC | H-13 | 5th layer | " | 1.78 | −0.01 | 68 | 63 | Comp. Ex. |
| 011 | " | H-9 | " | " | 1.75 | 0.00 | 72 | 63 | " |
| 012 | " | H-17 | " | " | 1.78 | 0.00 | 73 | 62 | " |
| 013 | " | H-19 | " | " | 1.73 | −0.01 | 71 | 63 | " |
| 014 | " | H-20 | " | " | 1.77 | 0.00 | 73 | 60 | " |
| 015 | " | H-22 | " | " | 1.81 | 0.00 | 72 | 61 | " |
| 016 | R-2 | H-1 | " | based on amount of coupler 10 mol % | 1.12 | — | 38 | 56 | " |
| 017 | " | H-1 | " | based on amount of coupler 20 mol % | 0.74 | — | 41 | 56 | " |
| 018 | " | H-12 | " | based on amount of coupler 10 mol % | 1.18 | — | 36 | 57 | " |
| 019 | C-20) | — | — | — | 2.34 | −0.13 | 43 | 52 | Comp. Ex. |
| 020 | " | H-1 | 5th layer | based on amount of coupler 5 mol % | 2.32 | −0.13 | 66 | 62 | Invention |
| 021 | " | " | " | 10 mol % | 2.31 | −0.14 | 76 | 65 | " |
| 022 | " | " | " | 25 mol % | 2.27 | −0.16 | 81 | 68 | " |
| 023 | " | H-3 | " | 10 mol % | 2.30 | −0.13 | 77 | 64 | " |
| 024 | " | H-8 | " | " | 2.33 | −0.14 | 75 | 64 | " |
| 025 | " | H-12 | " | " | 2.29 | −0.14 | 78 | 65 | " |
| 026 | " | H-13 | " | " | 2.31 | −0.15 | 78 | 64 | " |
| 027 | " | H-9 | " | " | 2.27 | −0.13 | 71 | 63 | " |
| 028 | C-20) | H-15 | 5th layer | based on amount of coupler 10 mol % | 2.28 | −0.14 | 73 | 64 | Invention |
| 029 | " | H-20 | " | based on amount of coupler 10 mol % | 2.26 | −0.13 | 70 | 62 | " |
| 030 | " | H-22 | " | based on amount of coupler 10 mol % | 2.27 | −0.13 | 72 | 63 | " |
| 031 | " | H-17 | " | based on amount of coupler 10 mol % | 2.30 | −0.13 | 68 | 63 | " |
| 032 | " | H-19 | " | based on amount of coupler 10 mol % | 2.30 | −0.13 | 65 | 62 | " |
| 033 | C-28) | — | — | — | 2.28 | −0.16 | 48 | 47 | Comp. Ex. |
| 034 | " | H-1 | 5th layer | based on amount of coupler 10 mol % | 2.21 | −0.17 | 81 | 60 | Invention |
| 035 | " | H-3 | " | based on amount of coupler 10 mol % | 2.24 | −0.18 | 80 | 61 | " |
| 036 | " | H-8 | " | based on amount of coupler 10 mol % | 2.23 | −0.18 | 78 | 60 | " |
| 037 | C-28) | H-12 | 5th layer | based on amount of coupler 10 mol % | 2.25 | −0.17 | 82 | 62 | Invention |
| 038 | " | H-13 | " | based on amount of coupler 10 mol % | 2.24 | −0.16 | 84 | 60 | " |
| 039 | " | H-9 | " | based on amount of coupler 10 mol % | 2.22 | −0.16 | 75 | 58 | " |
| 040 | " | H-20 | " | based on amount of coupler | 2.21 | −0.17 | 73 | 59 | " |

TABLE A-continued

| Sample No. | Cyan Coupler | Nondiffusing Compound of Invention Type | Layer (added) | Amount Added | Max. Color Density (Dmax) | ΔG/R Value | Fastness of Cyan Dye Image (at 70° C., 70% RH) (%) | Fastness of Yellow Dye Image to Light (intermittent irradiation of Xe light) (%) | Remarks |
|---|---|---|---|---|---|---|---|---|---|
| 041 | " | H-22 | " | 10 mol % based on amount of coupler | 2.19 | −0.16 | 76 | 59 | " |
| 042 | " | H-17 | " | 10 mol % based on amount of coupler | 2.20 | −0.16 | 69 | 60 | " |
| 043 | " | H-19 | " | 10 mol % based on amount of coupler | 2.25 | −0.16 | 68 | 60 | " |
| 044 | C-18) | — | — | 10 mol % — | 2.37 | −0.13 | 45 | 53 | Comp. Ex. |
| 045 | " | H-1 | 5th layer | based on amount of coupler | 2.35 | −0.14 | 74 | 64 | Invention |
| 046 | C-40) | — | — | 10 mol % — | 2.24 | −0.17 | 51 | 48 | Comp. Ex. |
| 047 | " | H-1 | 5th layer | based on amount of coupler | 2.21 | −0.18 | 87 | 61 | Invention |
| 048 | C-1) | — | — | 10 mol % — | 2.18 | −0.12 | 32 | 39 | Comp. Ex. |
| 049 | " | H-1 | 5th layer | based on amount of coupler | 2.09 | −0.13 | 71 | 57 | Invention |
| 050 | C-47) | — | — | 10 mol % — | 1.96 | −0.15 | 24 | 52 | Comp. Ex. |
| 051 | " | H-1 | 5th layer | based on amount of coupler | 1.92 | −0.16 | 69 | 63 | Invention |
| 052 | " | H-12 | " | 10 mol % based on amount of coupler | 1.93 | −0.16 | 71 | 61 | " |
| 053 | " | H-9 | " | 10 mol % based on amount of coupler | 1.91 | −0.15 | 65 | 59 | " |
| 054 | " | H-20 | " | 10 mol % based on amount of coupler | 1.94 | −0.16 | 62 | 59 | " |
| 055 | ExC | Cpd 4 | 4th layer | 10 mol % 0.03 g/m$^2$ | 1.98 | +0.08 | 76 | 61 | Comp. Ex. |
| 056 | " | " | " | 0.04 g/m$^2$ | 1.94 | 0.00 | 75 | 60 | " |
| 057 | " | " | " | 0.05 g/m$^2$ | 1.86 | −0.03 | 73 | 58 | " |
| 058 | " | " | " | 0.06 g/m$^2$ | 1.77 | −0.05 | 70 | 57 | " |
| 059 | " | H-1 | " | 0.03 g/m$^2$ | 1.85 | −0.01 | 78 | 63 | " |
| 060 | " | " | " | 0.04 g/m$^2$ | 1.74 | −0.04 | 80 | 64 | " |
| 061 | " | H-12 | " | 0.03 g/m$^2$ | 1.82 | −0.02 | 78 | 64 | " |
| 062 | " | H-9 | " | " | 1.84 | −0.01 | 79 | 63 | " |
| 063 | " | H-19 | " | " | 1.87 | −0.02 | 77 | 62 | " |
| 064 | C-20) | Cpd 4 | 4th layer | 0.03 g/m$^2$ | 2.38 | −0.06 | 49 | 55 | Comp. Ex. |
| 065 | " | " | " | 0.04 g/m$^2$ | 2.34 | −0.13 | 43 | 52 | " |
| 066 | " | " | " | 0.05 g/m$^2$ | 2.24 | −0.16 | 36 | 49 | " |
| 067 | " | " | " | 0.06 g/m$^2$ | 2.16 | −0.18 | 31 | 47 | " |
| 068 | " | H-1 | " | 0.03 g/m$^2$ | 2.35 | −0.17 | 75 | 63 | Invention |
| 069 | " | " | " | 0.04 g/m$^2$ | 2.33 | −0.19 | 82 | 65 | " |
| 070 | " | H-3 | " | 0.03 g/m$^2$ | 2.32 | −0.18 | 74 | 61 | " |
| 071 | " | H-4 | " | " | 2.31 | −0.16 | 73 | 62 | " |
| 072 | " | H-8 | " | " | 2.33 | −0.17 | 74 | 60 | " |
| 073 | C-20) | H-12 | 4th layer | 0.03 g/m$^2$ | 2.30 | −0.17 | 76 | 62 | Invention |
| 074 | " | H-12<br>Cpd 4 | " | 0.02 g/m$^2$<br>0.02 g/m$^2$ | 2.28 | −0.20 | 71 | 59 | " |
| 075 | " | H-13 | " | 0.03 g/m$^2$ | 2.31 | −0.18 | 73 | 62 | " |
| 076 | " | H-9 | " | " | 2.32 | −0.16 | 70 | 59 | " |
| 077 | " | H-15 | " | " | 2.32 | −0.16 | 68 | 60 | " |
| 078 | " | H-20 | " | " | 2.33 | −0.16 | 69 | 59 | " |
| 079 | " | H-22 | " | " | 2.31 | −0.15 | 68 | 61 | " |
| 080 | " | H-17 | " | " | 2.30 | −0.15 | 65 | 57 | " |
| 081 | " | H-19 | " | " | 2.32 | −0.15 | 66 | 58 | " |
| 082 | C-28) | Cpd 4 | 4th layer | 0.03 g/m$^2$ | 2.34 | −0.10 | 51 | 48 | Comp. Ex. |
| 083 | " | H-1 | " | " | 2.33 | −0.21 | 77 | 56 | Invention |
| 084 | " | H-3 | " | " | 2.34 | −0.22 | 74 | 54 | " |
| 085 | " | H-4 | " | " | 2.33 | −0.20 | 75 | 55 | " |
| 086 | " | H-12 | " | " | 2.32 | −0.22 | 74 | 54 | " |
| 087 | " | H-13 | " | " | 2.31 | −0.21 | 73 | 55 | " |
| 088 | " | H-9 | " | " | 2.35 | −0.19 | 70 | 53 | " |
| 089 | " | H-15 | " | " | 2.34 | −0.19 | 69 | 53 | " |
| 090 | " | H-20 | " | " | 2.32 | −0.18 | 70 | 52 | " |
| 091 | C-28) | H-22 | 4th layer | 0.03 g/m$^2$ | 2.33 | −0.19 | 71 | 52 | Invention |
| 092 | " | H-17 | " | " | 2.30 | −0.17 | 67 | 52 | " |
| 093 | " | H-19 | " | " | 2.33 | −0.17 | 66 | 51 | " |

TABLE A-continued

| Sample No. | Cyan Coupler | Nondiffusing Compound of Invention Type | Layer (added) | Amount Added | Max. Color Density (Dmax) | ΔG/R Value | Fastness of Cyan Dye Image (at 70° C., 70% RH) (%) | Fastness of Yellow Dye Image to Light (intermittent irradiation of Xe light) (%) | Remarks |
|---|---|---|---|---|---|---|---|---|---|
| 094 | C-18) | Cpd 4 | " | " | 2.40 | −0.06 | 49 | 53 | Comp. Ex. |
| 095 | " | H-1 | " | " | 2.41 | −0.15 | 72 | 59 | Invention |
| 096 | " | H-12 | " | " | 2.39 | −0.16 | 68 | 58 | " |
| 097 | C-40) | Cpd 4 | " | " | 2.29 | −0.07 | 53 | 47 | Comp. Ex. |
| 098 | " | H-1 | " | " | 2.27 | −0.17 | 74 | 53 | Invention |
| 099 | " | H-12 | " | " | 2.28 | −0.16 | 73 | 54 | " |
| 100 | C-1) | Cpd 4 | 4th layer | 0.03 g/m$^2$ | 2.21 | −0.04 | 35 | 40 | Comp. Ex. |
| 101 | " | H-1 | " | " | 2.22 | −0.16 | 65 | 48 | Invention |
| 102 | " | H-12 | " | " | 2.21 | −0.16 | 62 | 49 | " |
| 103 | C-47) | Cpd 4 | " | " | 1.99 | −0.08 | 27 | 52 | Comp. Ex. |
| 104 | " | H-1 | " | " | 1.97 | −0.16 | 60 | 59 | Invention |
| 105 | " | H-12 | " | " | 1.97 | −0.17 | 61 | 58 | " |
| 106 | ExC | Cpd 4 | 2nd layer | 0.05 g/m$^2$ | 1.95 | 0.00 | 44 | 62 | Comp. Ex. |
| 107 | " | H-1 | " | " | 1.94 | −0.01 | 45 | 67 | " |
| 108 | " | H-13 | " | " | 1.94 | 0.00 | 45 | 69 | " |
| 109 | C-20) | Cpd 4 | 2nd layer | 0.05 g/m$^2$ | 2.33 | −0.13 | 47 | 55 | Comp. Ex. |
| 110 | " | H-1 | " | " | 2.34 | −0.14 | 60 | 81 | Invention |
| 111 | " | H-8 | " | " | 2.33 | −0.14 | 58 | 79 | " |
| 112 | " | H-13 | " | " | 2.35 | −0.14 | 59 | 78 | " |
| 113 | C-28) | Cpd 4 | " | " | 2.27 | −0.10 | 49 | 49 | Comp. Ex. |
| 114 | " | H-1 | " | " | 2.29 | −0.11 | 61 | 75 | Invention |
| 115 | " | H-13 | " | " | 2.28 | −0.10 | 60 | 70 | " |
| 116 | C-47) | Cpd 4 | " | " | 1.95 | −0.08 | 25 | 54 | Comp. Ex. |
| 117 | " | H-1 | " | " | 1.95 | −0.09 | 41 | 77 | Invention |
| 118 | C-20) | Cpd 4 | 4th layer | 0.03 g/m$^2$ | 2.37 | −0.06 | 46 | 56 | Comp. Ex. |
| | | Cpd 4 | 2nd layer | 0.05 g/m$^2$ | | | | | |
| 119 | " | H-1 | 4th layer | 0.03 g/m$^2$ | 2.37 | −0.18 | 85 | 84 | Invention |
| | | H-1 | 2nd layer | 0.05 g/m$^2$ | | | | | |
| 120 | " | H-12 | 4th layer | 0.03 g/m$^2$ | 2.36 | −0.17 | 84 | 83 | " |
| | | H-12 | 2nd layer | 0.05 g/m$^2$ | | | | | |
| 121 | " | H-1 | 4th layer | 0.03 g/m$^2$ | 2.38 | −0.17 | 88 | 86 | " |
| | | H-13 | 2nd layer | 0.05 g/m$^2$ | | | | | |
| 122 | " | Cpd 4 | 6th layer | 0.01 g/m$^2$ | 2.26 | −0.13 | 35 | 59 | Comp. Ex. |
| 123 | " | H-1 | " | " | 2.32 | −0.14 | 65 | 61 | Invention |
| 124 | " | H-8 | " | " | 2.31 | −0.14 | 66 | 61 | " |
| 125 | " | H-12 | " | " | 2.34 | −0.15 | 63 | 60 | " |
| 126 | " | H-13 | " | " | 2.33 | −0.14 | 62 | 62 | " |

It can be seen from the results in Table A above that when the nondiffusing compounds of the present invention are used together with the cyan couplers of the present invention in the same layer (Samples 020 to 032, 034 to 043, 045, 047, 049 and 051 to 054), the fastness of the cyan dye image on dark storage can be greatly improved in comparison with the case where the nondiffusing compound is not present (Samples 019, 031, 044, 046, 048 and 050). Such an improved effect as mentioned above can not be obtained when Comparative Coupler ExC is used (Samples 001 and 005 to 015).

The results also show that the AG/R values of the couplers of the present invention are small in comparison with the value of comparative coupler ExC, and hence the couplers of the present invention are couplers with excellent hue. Comparative couplers R-1 and R-2 which are conventionally considered to have excellent hue, do not provide sufficient color density. The fastness of the cyan dye images obtained therefrom is very poor, and the fastness can be only slightly improved even when the nondiffusing compound of the present invention is added.

Comparative coupler M-1 has a skeleton similar to that of the coupler of the present invention. However, the developed color image has a magenta color.

It will be understood that when the nondiffusing compounds of the present invention are employed in the Fourth Layer (color mixing inhibiting interlayer) adjacent the layer containing the cyan couplers of the present invention (Samples 068 to 081, 083 to 093, 095, 096, 098, 099, 101, 102, 104 and 105), the ΔG/R values are small and the ability of inhibiting color mixing is high even when the amounts of the compounds added are small in comparison with the case where the hydroquinone color mixing inhibitor Cpd-4 is used (Samples 064 to 067). When the amount of Cpd-4 is increased, the ΔG/R value is reduced. However, the density of the cyan dye image is lowered with a reduction in the ΔG/R value. Accordingly, the samples of the present invention show that the fastness of cyan dye image in the dark can be greatly improved, and at the same time, it can be seen that the fastness of the yellow dye image to light is slightly improved.

Further, when the nondiffusing compounds of the present invention are added to the Second Layer (Samples 110 to 112, 114, 115 and 117), the effect of improving the fastness of cyan dye image can be obtained, though the degree of the improvement is slight. In this case, it can be found that the fastness of yellow dye image to light can be greatly improved.

It can also be seen that when the nondiffusing compounds of the present invention are added to the Sixth Layer (Samples 123 to 126), an effect of improving the fastness of cyan dye image can be obtained.

On the other hand, when the hydroquinone color mixing inhibitor Cpd-4 is added to the Sixth Layer (Sample 122), the fastness of cyan dye image is reduced.

As described above, when the nondiffusing compounds of the present invention are used in combination with the cyan couplers of the present invention, an excellent effect of inhibiting color mixing can be obtained and an excellent effect in preventing fading from occurring can be obtained, though the levels of these effects are different depending on the layers to which the compounds are added.

EXAMPLE 2

The procedure of Example 1 was repeated except that each of the following yellow couplers ExY-1 and ExY-2 was used in place of yellow coupler ExY, and the coating weight of yellow coupler and silver halide were 80 mol % of those of Examples 1. Evaluation was made in the same manner as in Example 1.

ExY-1

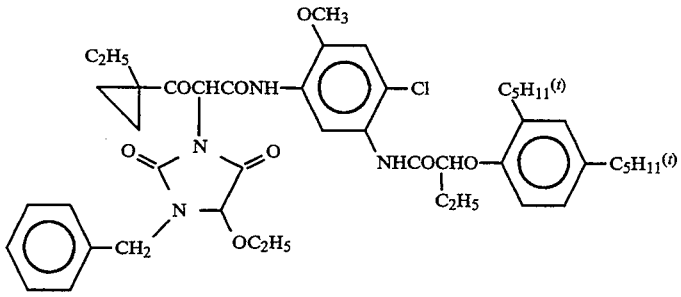

ExY-2

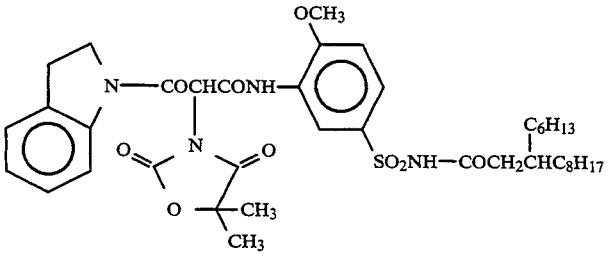

Similar results to those of Example 1 were obtained.

EXAMPLE 3

A sample having the same structure as that of the Sample 701 of Example 7 of JP-A-2-139544 was prepared. Cyan couplers (Ex-2) present in the Third and Fourth Layers of this sample were replaced with the cyan couplers of the present invention, and the nondiffusing compounds of the present invention were added to the Third Layer, the Fourth Layer and the Fourteenth Layer in the same manner as in Example 1 to prepare samples. Similarly, the color mixing inhibitor (Ex-5) present in the Sixth Layer and the Tenth Layer was replaced with the nondiffusing compounds of the present invention to obtain samples. Evaluation was made in the same manner as in Example 1. Similar results to those of Example 1 were obtained.

Ex-14 (0.050 g/m$^2$) was added to the Fourth Layer of the above samples, Ex-15 (0.020 g/m$^2$) was added to the Fifth Layer of the above samples, and Ex-2 (0.015 g/m$^2$) was added to the Ninth Layer of the above samples. Further, Ex-16 (0.065 g/m$^2$) and Ex-17 (0.020 g/m$^2$) were used in place of Ex-11 and Ex-13 present the Ninth Layer of the above samples to prepare additional samples. Evaluation was made in the same manner as described above. Similar results to those obtained above were obtained.

Furthermore, an equimolar amount of each of Ex-18 and Ex-19 was used in place of Ex-8 and Ex-9 present in the Eleventh Layer, the Twelfth Layer and the Thirteenth Layer of the above samples to prepare further samples. Evaluation was made in the same manner as described above. Similar results to those obtained above were obtained.

Ex-14

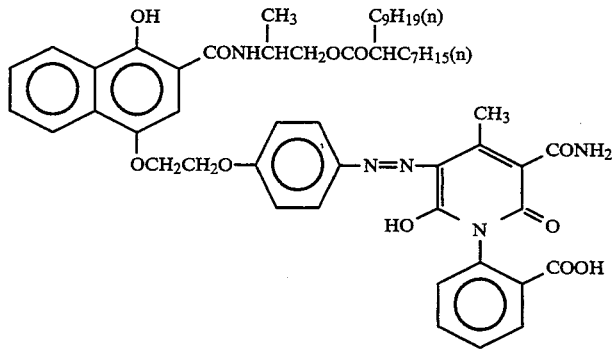

-continued
Ex-15
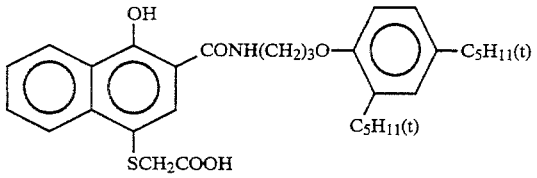
Ex-16
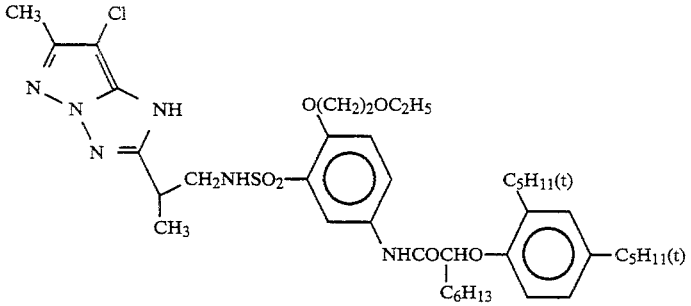
Ex-17
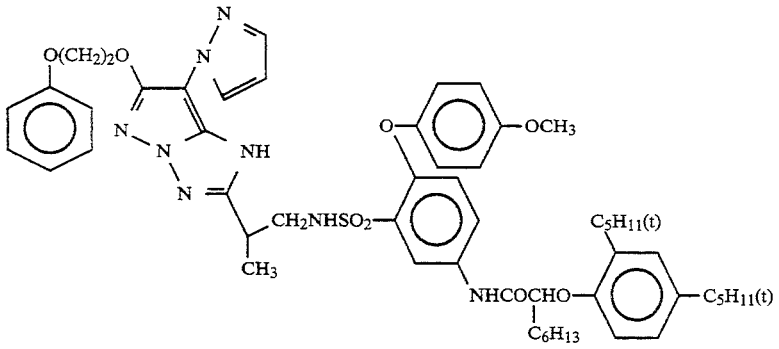
Ex-18
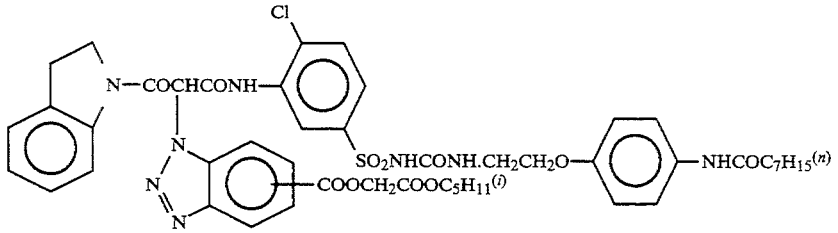
Ex-19
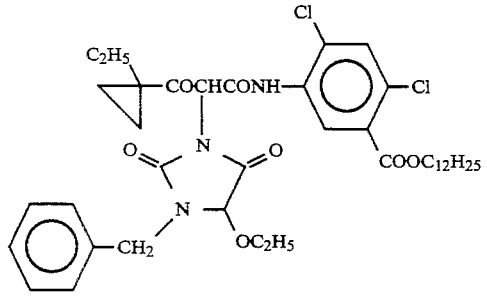

EXAMPLE 4

A sample having the same structure as that of the light-sensitive material (Sample 601) of Example 6 of JP-A-2-139544 was prepared. The cyan couplers C-1, C-2 and C-3 used in the Fourth Layer, the Fifth Layer and Sixth Layer of this sample were replaced with the couplers of the present invention shown in Example 1. Further, the nondiffusing compounds of the present invention were added to the Fourth to Sixth Layers and the Eighteenth Layer in the same manner as in Example 1 to prepare samples. In another experiment, the color mixing inhibitor (Cpd-A) used in the Eighth Layer and the Thirteenth Layer was replaced by the nondiffusing compounds of the present invention to prepare samples. Evaluation was in the same manner as in Example 1. Similar results to those of Example 1 were obtained.

Further, C-6 used in each of the Sixteenth Layer and the Seventeenth Layer of the above samples was replaced by an equimolar amount of C-10, and C-4 and C-7 used in the Ninth to Eleventh Layers were replaced by C-8 in such an amount that the amount of C-8 was 80 mol % of the combined amount of C-4 and C-7 to prepare samples. The samples were evaluated, and similar results to those described above were obtained.

C-8

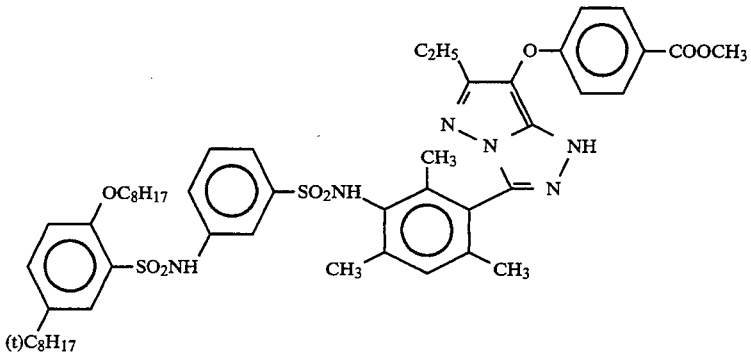

C-10

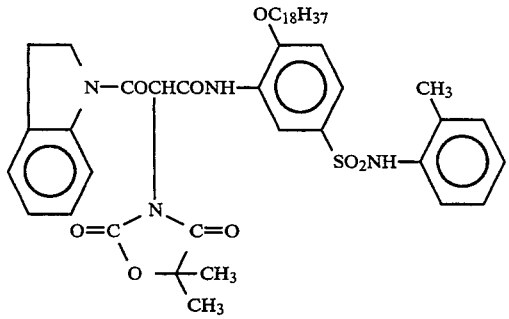

It can be seen from the above disclosure that according to the present invention, a silver halide color photographic material which gives a dye image which has excellent hue and fastness and has improved properties with regard to color mixing can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, and wherein said photographic material contains at least one pyrroloazole cyan coupler represented by following general formula (I) or (III)

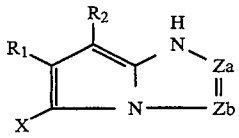

(I)

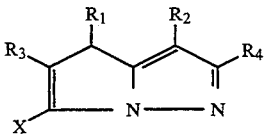

(III)

wherein $Z_a$ and $Z_b$ each represents —C($R_4$)= or —N=, provided that one of $Z_a$ and $Z_b$ is —N= and the other is —C($R_4$)=; $R_1$ and $R_2$ each represent an electron attracting group having a Hammett's substituent constant σp value of at least 0.20 provided that the sum of σp values of $R_1$ and $R_2$ in general formula (I) is at least 0.65; $R_3$ and $R_4$ each represents a hydrogen atom or a substituent group; and X represents a hydrogen atom or a group which is eliminated on coupling with oxidation product an aromatic primary amine color developing agent; or $R_1$, $R_2$, $R_3$, $R_4$ or X may be a bivalent group and the compound may be in the form of a dimer or a higher polymer through the bivalent group, or may form a homopolymer or a copolymer of a monomer or monomers wherein the residue of the coupler is bonded to a high-molecular weight chain; and at least one member of non-color forming, nondiffusing compounds represented by the following general formula (H)

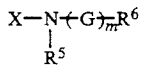

(H)

wherein X represents —N($R^7$)$R^8$ or —O$R^9$; $R^7$ represents a hydrogen atom, an aliphatic group, an aromatic group or a heterocyclic group; $R^8$ and $R^9$ each represents a hydrogen atom or a group which is eliminated under alkaline conditions; $R^6$ represents a hydrogen atom, an aliphatic group, an aromatic group, a heterocyclic group, a cyano group, a nitro group or a hydrazino group; or $R^7$ and $R^6$ may combine together to form a ring; $R^5$ represents a hydrogen atom, an alkyl group or a group which is eliminated under alkaline conditions; two or more compounds may be bonded to each other at the position of $R^7$, $R^6$ or $R^5$ to form an oligomer or a polymer; G represents —CO—, —$SO_2$—, —SO—, —CON($R^{10}$)—, —COO—, —$SO_2$N($R^{11}$)—, —PO($R^{12}$)—, —C(=S)— or an iminomethylene group; $R^{10}$ and $R^{11}$ each represents a hydrogen atom, an alkyl group or an aryl group; $R^{12}$ represents an alkyl group or an aryl group; and m represents 0, 1 or 2, and when m is 2, the two G groups may be the same or different.

2. The silver halide color photographic material as in claim 1, wherein the compound of general formula (H) is present in a hydrophilic colloid layer adjacent a silver halide emulsion layer containing the pyrroloazole cyan coupler of general formula (I) or (III).

3. The silver halide color photographic material as in claim 2, wherein said hydrophilic colloid layer is a light-insensitive interlayer interposed between two light-sensitive silver halide emulsion layers.

4. The silver halide color photographic material as in claim 1, wherein said at least one pyrroloazole cyan coupler is represented by general formula (I).

5. The silver halide color photographic material as in claim 1, wherein said at least one pyrroloazole cyan coupler is represented by the following general formula (I-a)

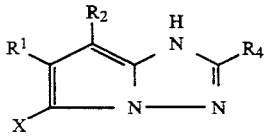

(I-a)

wherein $R_1$ and $R_2$ each represent an electron attracting group having a Hammett's substituent constant σp value of at least 0.20 provided that the sum of σp values of $R_1$ and $R_2$ in general formula (I-a) is at least 0.65; $R_4$ represents a hydrogen atom or a substituent group; and X represents a hydrogen atom or a group which is eliminated on coupling with oxidation product an aromatic primary amine color developing agent; or $R_1$, $R_2$, $R_4$ or X may be a bivalent group and the compound may be in the form of a dimer or a higher polymer through the bivalent group, or may form a homopolymer or a copolymer of a monomer or monomers wherein the residue of the coupler is bonded to a high-molecular weight chain.

6. The silver halide color photographic material as in claim 1, wherein said non-color forming, nondiffusing compounds represented by general formula (H) are selected from the group consisting of the compounds represented by the following general formulas (H-I) to (H-IV) and polymers comprising a repeating unit represented by the following general formula (H-V)

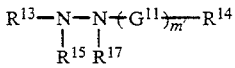

(H-I)

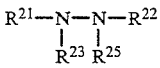

(H-II)

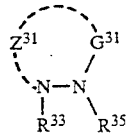

(H-III)

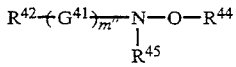

(H-IV)

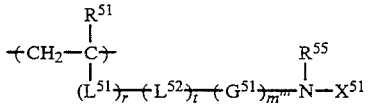

(H-V)

wherein $R^{13}$ and $R^{21}$ have the same meaning as $R^7$ in general formula (H) ; $G^{11}$, $G^{31}$, $G^{41}$ and $G^{51}$, have the same meaning as G; $R^{15}$, $R^{23}$ and $R^{33}$ have the same meaning as $R^8$; $R^{44}$ has the same meaning as $R^9$; $R^{17}$, $R^{25}$, $R^{35}$, $R^{45}$ and $R^{55}$ have the same meaning as $R^5$; m', m'', m''' have the same meaning as m; $X^{51}$ has the same meaning as X; $R^{14}$ represents a hydrogen atom, an aliphatic group, an aromatic group, a heterocyclic group or a hydrazino group; $R^{22}$ represents a cyano group, a nitro group, a perfluoroalkyl group or a heterocyclic group; $R^{42}$ represents an aliphatic group, an aromatic group or a heterocyclic group; $Z^{31}$ represents a non-metallic atomic group required for forming a four-membered to eight-membered ring; $R^{51}$ represents a hydrogen atom, a halogen atom or an alkyl group; $L^{51}$ represents —CO—, —$SO_2$—, —NH—, —O—, —S—, phenylene, an alkylene group or a bivalent bonding group composed of a combination thereof; $L^{52}$ represents a bivalent group formed by removing hydrogen atom from $R^7$ in general formula (H); and r and t each represents 0 or 1.

7. The silver halide color photographic material as in claim 1, wherein said non-color forming, nondiffusing compounds represented by general formula (H) are compounds represented by the following general formula (H-VI)

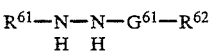

(H-VI)

wherein $R^{61}$ represents an aromatic group; $R^{62}$ represents an aliphatic group, an aromatic group or a heterocyclic group; $G^{61}$ represents —CO—, —COCO—, —CON($R^{66}$)— or —COO—; $R^{66}$ has the same meaning as $R^{10}$ in general formula (H); and $R^{61}$ or $R^{66}$ includes a ballast group.

8. The silver halide color photographic material as in claim 1, wherein said non-color forming, nondiffusing compounds represented by general formula (H) are compounds represented by the following general formula (H-VII)

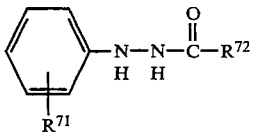

(H-VII)

wherein $R^{71}$ is a substituent on the benzene ring; $R^{72}$ represents an aliphatic group or an aromatic group; and any one of $R^{71}$ and $R^{72}$ has a ballast group having not less than 8 carbon atoms.

9. The silver halide color photographic material as in claim 1, wherein said at least one pyrroloazole cyan coupler is represented by general formula (I) and said non-color forming, nondiffusing compounds represented by general formula (H) are compounds represented by the following general formula (H-VII)

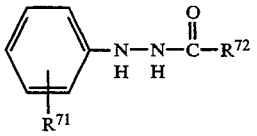

(H-VII)

wherein $R^{71}$ is a substituent on the benzene ring; $R^{72}$ represents an aliphatic group or an aromatic group; and any one of $R^{71}$ and $R^{72}$ has a ballast group having not less than 8 carbon atoms.

10. The silver halide color photographic material as in claim 1, wherein said at least one pyrroloazole cyan coupler is represented by general formula (I-a)

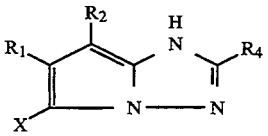

(I-a)

wherein $R_1$ and $R_2$ each represent an electron attracting group having a Hammett's substituent constant $\sigma p$ value of at least 0.20 provided that the sum of $\sigma p$ values of $R_1$ and $R_2$ in general formula (I-a) is at least 0.65; $R_4$ represents a hydrogen atom or a substituent group; and X represents a hydrogen atom or a group which is eliminated on coupling with oxidation product an aromatic primary amine color developing agent; or $R_1$, $R_2$, $R_4$ or X may be a bivalent group and the compound may be in the form of a dimer or a higher polymer through the bivalent group, or may form a homopolymer or a copolymer of a monomer or monomers wherein the residue of the coupler is bonded to a high-molecular weight chain; and said non-color forming, nondiffusing compounds represented by general formula (H) are compounds represented by the following general formula (H-VII)

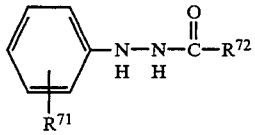

(H-VII)

wherein $R^{71}$ is a substituent on the benzene ring; $R^{72}$ represents an aliphatic group or an aromatic group; and any one of $R^{71}$ and $R^{72}$ has a ballast group having not less than 8 carbon atoms.

11. The silver halide color photographic material as in claim 1, wherein said at least one pyrroloazole cyan coupler is represented by general formula (III).

12. The silver halide color photographic material as in claim 1, wherein a cyan coupler according to general formula (I) is present in an emulsion layer.

13. The silver halide color photographic material as in claim 1, wherein a cyan coupler according to general formula (I) is present in a light-insensitive interlayer.

14. The silver halide color photographic material as in claim 1, wherein a cyan coupler according to general formula (III) is present in an emulsion layer.

15. The silver halide color photographic material as in claim 1, wherein a cyan coupler according to general formula (III) is present in a light-insensitive interlayer.

* * * * *